US006308356B1

(12) United States Patent
Frederick et al.

(10) Patent No.: US 6,308,356 B1
(45) Date of Patent: Oct. 30, 2001

(54) SUBSTANTIALLY ENVIRONMENTAL-POLLUTION-FREE CLEANING METHOD AND DEVICE EMPLOYING ELECTRIC ENERGY AND SURFACE PHYSICAL PROPERTIES

(76) Inventors: Max B. Frederick, P.O. Box 66, Gladstone, OR (US) 97027; Brian Frederick, 8455 Hwy. 9, Ben Lomond, CA (US) 95005

( * ) Notice: Subject to any disclaimer, the term of this patent is extended or adjusted under 35 U.S.C. 154(b) by 0 days.

(21) Appl. No.: 09/053,103

(22) Filed: Apr. 1, 1998

(51) Int. Cl.[7] ..... D06F 39/02
(52) U.S. Cl. ..... 8/158; 8/159; 68/17 A
(58) Field of Search ..... 68/17 A, 207; 8/159, 158; 205/693, 704, 705

(56) References Cited

U.S. PATENT DOCUMENTS

| | | | |
|---|---|---|---|
| 2,997,870 | 8/1961 | Serra | 68/173 |
| 4,066,393 | 1/1978 | Morey et al. | 8/137 |
| 4,756,529 | 7/1988 | Stillinger | 273/58 |

(List continued on next page.)

OTHER PUBLICATIONS

Matsuoka, Takahisa and Iwamoto, Mutsuo, "Surface Tension and Permeability of Water Treated by Polar Crystal Tourmaline", Japanese Journal of Food Science and Technology, Nippon Shokuhin Kogyo Gakkaishi vol. 38, No. 5, p. 422–424, 1991.

Nakamura, T; Fujishira, K.; Kubo, T.; Iida, M., "Tourmaline and Lithium Niobate Reaction with Water", Ferroelectrics, vol. 155, iss: 1–4, p. 207–212, 1994.

(List continued on next page.)

*Primary Examiner*—Frankie L. Stinson

(57) ABSTRACT

A washing method and apparatus characterized by employment of the electric form of energy in addition to the traditional three forms of energy (kinetic energy, thermal energy, and chemical energy) to do the work of cleaning, thereby reducing the requirement for and dependency on the traditional three forms of energy. Electric charge is employed to do work of cleaning by various physical phenomena. The phenomena include, but are not limited to effecting the physical characteristics of surface chemistry, the physical characteristics of water, and the chemical characteristics of water, Such characteristics include but are not limited to surface tension, agitation, hydrolization, and adhesion. Such effects of the physical or chemical characteristics are temporary, and are not detectable after the washing water is discarded so as to have minimal polluting effect on the environment. After the cleaning work is done, this temporary energy effect of the physical or chemical characteristics is just as transient, undetectable and non-polluting as is the thermal energy of hot water that has been cooled or the kinetic energy of moving water that has been stopped. Previous to this invention, the work of cleaning was done by three forms of energy: Thermal energy, kinetic energy, and chemical energy. This invention adds electric energy to the forms of energy that do the work of cleaning. Of the four forms of energy, the only one that remains in the waste water is chemical energy. Adding this additional form of energy allows the reduction of requirement for work to be done by any or all of the other forms of energy. The net result is the transfer of the work load from chemical energy, thus resulting in less dependence on the one form of energy that pollutes the environment.

6 Claims, 7 Drawing Sheets

U.S. PATENT DOCUMENTS

| | | | | |
|---|---|---|---|---|
| 5,211,689 | * | 5/1993 | Kobayashi . | |
| 5,309,739 | * | 5/1994 | Lee . | |
| 5,358,617 | | 10/1994 | Ibbott | 204/248 |
| 5,421,174 | * | 6/1995 | Kim et al. . | |
| 5,531,869 | | 7/1996 | Kubo | 503/202 |
| 5,552,656 | | 9/1996 | Taylor | 310/337 |
| 5,552,657 | | 9/1996 | Epstein et al. | 310/339 |
| 5,569,388 | | 10/1996 | Kubo | 210/764 |
| 5,578,889 | | 11/1996 | Epstein | 310/339 |
| 5,599,455 | | 2/1997 | Hukai | 210/663 |
| 5,601,909 | | 2/1997 | Kubo | 442/417 |
| 5,621,264 | | 4/1997 | Epstein et al. | 310/339 |
| 5,794,290 | * | 8/1998 | Roberts . | |
| 5,918,487 | * | 7/1999 | Franceus . | |
| 5,978,994 | * | 11/1999 | Anderson . | |

OTHER PUBLICATIONS

Nishi, Y.; Yazawa, A.; Oguri, K.; Kanazaki, F.; Kaneko, T., "pH self–controlling induced by tourmaline", Journal of Intelligent Material Systems and Structures, vol.: 7, iss: 3, p. 260–3, 1996.

Publication No. 348, "The Physics & Cemistry of Cleaning", published by The New Zealand Department of Agriculture, Ruakura Agricultural Research Centre, Hamilton, New Zealand, observed on the internet at http://www.hitech-deterg.co.nz/farm/phyclean.htm on Jun. 27, 1998.

Heaton, Linda M. and Hackler, Nadine, "Laundry", Fact Sheet HE 4113, University of Florida, Cooperative Extension Service, p. 1, May, 1991.

WorldWide Scam, "The Laundry Product Showcase!", http://www.beach–party.com/worldwidescam2/show.htm, observed on the internet on Apr. 4, 1998 at 1:09 AM.

Toback, Bruce, "Laundry Balls and laundry Discs: How They Work", http://www.beach–party.com/worldwidescam2/lstuf.htm, observed on the internet on Apr. 4, 1998 at 1:29 AM.

Frederick, Max, B.; Guerrero, Alberto; Maddux, Joe T., Compactible Automatic Laundry Washing Machine to Improve Space Utilization in Living Units and Reduce Environmental Pollution, U. S. Patent Application Serial No. 08839683, filed Apr. 14, 1997.

* cited by examiner

| Symbol | Definition |
|---|---|
| $H^+$ | Hydrogen Ions |
| $H_3O^+$ | Hydronium Ions |
| $H_2O$ | Water Molecules |
| $H_3O_2^-$ | Hydroxide Ions |
| $OH^-$ | Hydroxyl Ions |
| - | Electron Concentration |

SUBSTANTIALLY ENVIRONMENTAL-POLLUTION-FREE CLEANING METHOD AND DEVICE EMPLOYING ELECTRIC ENERGY AND SURFACE PHYSICAL PROPERTIES

BACKGROUND—FIELD OF INVENTION

This invention relates to cleaning, to materials used in cleaning, and particularly to the employment of electric energy to do the work of cleaning by a method and device which operates to apply electrical energy directly to washing fluid at a site of cleaning, thus affecting the physical properties or characteristics of a cleaning substance, resulting in a reduced dependence on traditional chemical forms of energy to do the work of cleaning, and a reduced discharge of chemical waste, resulting in reduction of environmental pollution due to chemical waste discharge to a greater extent than heretofore possible.

BACKGROUND—DESCRIPTION OF PRIOR ART

Ideally, there should be no detectable difference in water before and after it is used for cleaning (other than the presence of the soil transferred from the laundry to the water). All forms of energy used to do the work of cleaning should have no lasting effect on the water used and should not be detected in the effluent. In the conventional chemical energy dominated laundry processes of the prior art, chemical energy is the only one of the three form of energy that violates this criteria.

The thermal energy of hot water has a temporary effect occurring in the water which is very effective in the cleaning process. There is no detectable difference in water that has been heated to aid in the cleaning process, once the cleaning is done and the water again cooled. Environmentally, this is the ideal situation.

The kinetic energy present in agitated water during the laundering process is not detectable once the cleaning is done and the water allowed to come to rest. Water that has induced turbulence during the cleaning process is no different after as compared to before it is used for cleaning.

The only source of energy used in the conventional cleaning process that causes a detectable difference is the energy of chemicals added to the water. Chemical energy from the addition of chemical substance to the water remains in the water after the cleaning process, and is the source of pollution caused by the cleaning process.

Thus is the long recognized and unfilled need to reduce the amount of polluting detergent chemicals being discharged into the environment.

The cleaning process of the prior art as used in the home laundry is a major contributor to pollution of the environment due to the discarding of spent chemicals into the environment.

Much of the resources used for producing laundry cleaning chemicals is non renewable.

It has not been practical to recycle spent laundry detergent chemicals from home laundry use.

Allergic reactions are caused by chemical residue in the fabric of clothes.

The health and growth of plants and animals are affected by chemical waste from home laundering.

The purity of drinking water is decreased by chemical waste from home laundering.

Water treatment requirements of public waste water is increased by chemical waste from home laundering.

Traditionally the cleaning process involved three different forms of energy used to dislodge soil from the items that were cleaned. Those forms of energy were kinetic energy, thermal energy, and chemical energy. Kinetic energy was from rubbing, scrubbing, or agitating. Thermal energy was from hot water. Chemical energy was principally from detergents. These forms of energy did the work of cleaning. To some extent, tradeoffs of one form of energy for another were employed. The amount of one form of energy was reduced at the cost of increasing the amount of another form. Chemical energy requirement was reduced by increasing the use of mechanical energy by rubbing, scrubbing, or agitating harder or longer. Thermal energy use was reduced by increasing the dependency on chemical energy.

Two significant developments increased the dependency on chemical energy in recent times.

First was the development of the automatic washing machine. The old fashioned ringer washer was used to clean several loads of wash before the water with it's laundry chemicals was discarded. The newer modern automatic washing machines, to eliminate the manual labor of removing the clothes from the wash tub to the rinse tub moved the washing and rinsing process to the same tub by changing the water rather than the clothes. Wash water was discarded after washing only one load of laundry. This resulted in a many fold increase in the number of loads of waste water, with it's polluting chemicals, being released into the environment each day.

The second development was the advent of the philosophy of saving energy by washing in cold water. In reality, the energy required to do the work of cleaning was not reduced. Only the source of energy was changed. More dependence on chemical energy was the change. More dependence on chemical energy resulted in a greater quantity of chemical pollutants released into the environment.

Ever since modern automatic washing machines reduced to one the number of loads of laundry to be cleaned by a single charge of cleaning solution, there has been a long recognized and unfilled need to reduce the amount of polluting detergent chemicals being discharged into the environment.

At the same time there has been a demand for improvements in the appearance, odor, and other characteristics of clean laundry.

Accordingly, in order to improve the cleaning efficiency, many clothes washing machine makers have utilized various methods including such methods as improving the agitators ability to scrub the laundry, extending the operating time of the motor during agitation, and improving the quality and/or increasing the quantity of detergent used in the washing machine. However, there were limits to improvements in the cleaning efficiency by the aforementioned methods for the following reasons:

(a) The methods utilizing increased mechanical force to improve the washing efficiency caused damage to the laundry or reduced efficiency of the washing machine.

(b) In methods utilizing increased amounts of detergent, a relatively large amount of the detergent did not react with the laundry and was discharged where it caused environmental pollution.

(c) Some detergent residue stuck to the laundry and thus the laundry was not effectively cleaned. Many people were allergic to detergent residue in the clothes they wore.

(d) Also, it was well known that if more than the recommended amount of detergent was used in the clothes washing machine, the washing efficiency of the washing machine was reduced.

Accordingly, inventors attempted to create several types of ionic water treatment devices to generate water containing non polluting chemical energy in the form of surface tension reducing ions for the purpose of reducing the amount of detergent required. In the absence of chemical detergent, all of these devices had the same shortcoming of the short life of oppositely polarized ions in the absence of energy to hold the mutually attracted ions apart.

U.S. Pat. No. 5,309,739 to Lee (1994) disclosed a device which claimed the generation of surface-tension-reducing hydroxyl ions for the purpose of reducing the amount of detergent required using tourmaline and ultrasonic energy. This device was integral to the washing machine and was required to be added on to the standard automatic washing machine at time of manufacture. The process was slow and at a point in the machine that was spatially removed from the point of the cleaning work. Any separation of the water into ions was quickly neutralized before reaching the locality where soil was being removed from the clothes, because the opposite nature of the charge on the ions caused them to attract each other and to be immediately neutralized. It has not become a commercial success because it was not significant in its effect.

U.S. Pat. No. 4,066,393 to Morey and Dooley (1978) disclosed a device which utilized a cation exchange resin device to remove calcium and/or magnesium ions from the water for the purpose of reducing the amount of detergent required. However, this device required a manual step in the washing process and it too was an add on to the standard automatic washing machine requiring mechanical assembly. It only softened the water by adding more chemicals to the water so the chemical detergent could work better. It did not replace the use of chemical detergent. It removed some metal ions from the water by adding others in substitution. It did not reduce pollution of the environment, it only moved the pollution from one waste product to another. And it did nothing to improve water that was already soft.

U.S. Pat. No. 5,358,617 to Ibbott (1994) disclosed a water treatment devise for use in a standard automatic washing machine which utilized electrically isolated electrodes of different electrochemical potential to ionize the wash water inside the washing machine for the purpose of reducing the amount of detergent required. However, the effectiveness of this device was quite limited by the slow rate of the process, and in this device the separation of the locality of ion generation and ion use was so great that the ions were neutralized by the time they got to the locality of the cleaning work.

U.S. Pat. No. 2,997,870 to Serra (1961) disclosed a washing machine claiming ionic generation due to friction of the motion of air, water, and an India rubber vessel for the purpose of reducing the amount of detergent required. However, ions thus produced were not effectively transported to the active site of the cleaning before being neutralized by their very nature of being oppositely polarized. And thus the machine was impractical to solve the unfilled need.

Devices utilizing the weak ionization developed by the mineral tourmaline have been proposed, and even marketed, to generate ions which reduce the surface tension of water. However, the process, if it did work, was so weak, and so slow, that it did not prove to be practical.

Many attempts have been made to utilize energy in the form of non chemical ionic phenomena to do the work of cleaning, but the products have not been as effective as the claims made. For example, devices such as plastic balls or ceramic discs that had been offered on the market had such a weak effect that courts of law in many states declared them to be fraud. None of them supplied enough energy, in the right place to do sufficient work to take the place of the work done by chemical detergent.

Electrostatic precipitators have been used for years to clean air of soil particles rather than let that form of pollution go up the smokestack. Currently there is no equivalent for particles in home laundry waste water. Instead, detergent molecules attach themselves to soil particles and are released with the soil particles into the environment.

Less harmful chemicals have been proposed to be substituted for more harmful chemicals. That is, chemicals that have not been declared to be so harmful but with less track record of being safe have been substituted, However, in doing so, the composition of the waste chemical has only been changed, the quantity has not been reduced, and the flow of spent chemicals polluting the environment continues.

None of these substitutions or devices have satisfied the unfilled need for reduction of the polluting chemical discharge from household laundry, nor have they contributed significantly to reduce the problem. To the contrary, more polluting chemicals have been developed to overcome the reduced effectiveness of the cleaning process to give the appearance of better cleaning. Among these are chemical brighteners, chemical whiteners, chemical perfumes, and chemical fabric softeners. The current use of the prior art method of cleaning continues to contribute significantly to environmental pollution. The long recognized and unfilled needs for increased cleaning effectiveness, and reduction of pollution produced by household laundry operations has not been met by the prior art.

OBJECTS AND ADVANTAGES

All three forms of energy of the prior art that are used to do the work of cleaning are related and it is possible by careful adjustment of one component to overcome limitations of either one or both of the other components. As an object of the invention, a fourth form, electric energy, is added, substituting, at least in part, for chemical energy. With the addition of this fourth form of energy, in sufficient quantity, and at the right place, the goal of reducing or even eliminating detergent chemical pollution from household laundering can be accomplished by careful adjustment of the other forms of energy. Electric or electrostatic energy, when properly applied by the inventive method, is used to accomplish, at least in part and to some extent, the work in it's various forms that has been done in the prior art by chemical detergents. Like thermal and kinetic energy, electrostatic energy added during the cleaning process is not detectable once the cleaning process is complete. Surprisingly, the rubbing between the water, laundry articles, and electrically polarized dielectric surfaces of the invention causes a surprising increase in the washing efficiency due to the generation of ionic action in the water at the right time and place to be useful during it's short life. By virtue of a simple looking device, and the unobvious benefits it enables, an entire, normal capacity washing machine is increased in cleaning efficiency. With no need to rinse a chemical residue from the laundry, this invention eliminates an energy wasting need for a separate non cleaning cycle for rinsing, making all cycles of the currently popular automatic washing machine into cleaning cycles.

Accordingly, several objects and advantages of the present invention are:

(a) to provide a cleaning method which does some of the work of cleaning using electrical energy in sufficient quantity and effectiveness to reduce the requirements for the other forms of energy which are thermal, kinetic, and chemical, in particular chemical, reducing or eliminating the need to discard chemical waste, filling that long recognized and unfilled need for reducing laundry chemical waste polluting the environment;

(b) to provide a cleaning method which protects our environment from pollution by making effective use of a minimal amount of detergent by substituting a non polluting source of energy to do the work of cleaning;

(c) to provide a form of detergent which is recycled rather than discarded;

(d) to provide a cleaning method which fills that long recognized and unfilled need for reducing detergent residue in the clean laundry by substituting a non polluting source of energy to do the work of cleaning;

(e) to provide a cleaning method which reduces the effect of chemical effluent on the health and growth of plants and animals by substituting a non polluting source of energy to do the work of cleaning;

(f) to provide a cleaning method which reduces the effect of chemical effluent on human drinking water by substituting a non polluting source of energy to do the work of cleaning;

(g) to provide a cleaning method which reduces the water treatment requirements of public waste water treatment plants to process laundry chemicals by substituting a non polluting source of energy to do the work of cleaning, thereby reducing the quantity of spent laundry chemicals needing treatment;

(h) to provide a cleaning method which reduces the dependency on chemical energy by substituting a non polluting source of energy to do the work of cleaning;

(i) to provide a cleaning method which improves the appearance, odor, and other characteristics of clean laundry by substituting a non polluting source of energy to do the work of cleaning;

(j) to provide a cleaning device or devices which embodies the methods of this invention; and (k) to provide a cleaning device suitable to be marketed as a commercial product to be used in place of or in addition to laundry detergent.

Unlike many other attempts to fill the need reduce chemical pollution of the environment, this invention operates in the manner to which the homemaker is already accustomed, and little, if any, instruction is needed.

For the preferred embodiment of the invention the operation is as simple as putting the device in the washing machine with the load of laundry, operating the machine normally, and, when the load is finished, removing the device from the machine, and taking the laundry out.

Or the device may be held in a hand and used for scrubbing as with a standard wash cloth or sponge.

For other embodiments, such as the one where the washing machine agitator itself is the implementation of the invention, the operation is even simpler. Load the machine with clothes, operate the machine normally, and take the clothes out when the washing is done.

In conjunction with the inventive device, other substances may be desired to be used, such as fabric softener. For such cases, just follow the directions that come with the other substances.

The water from the home laundry, being free of chemical detergent pollution can optionally be recycled to water the garden or yard.

An object of this invention is to exploit a heretofor unexploited form of energy to do the work of cleaning.

A further object of the present invention is to provide a means of exploiting the new technology of surface chemistry and utilizing electric energy to reduce the need for other forms of cleaning energy of the prior art. The combination provides a superior process of cleaning without increased damage to the items being cleaned nor to the environment.

A further object of the present invention is to provide a means of attracting and holding soil particles, removing them from the wash water, rather than flushing them down the drain. In similar fashion to the electrostatic precipitator removing soil particles from smoke so they do not pollute the air, a device made from the surface chemistry detergent of this invention can attract and hold soil particles removing them from the drained wash water. Again in similar fashion to the electrostatic precipitator, the device made from the inventive surface chemistry detergent can be renewed by reversing the attraction.

In an embodiment of the present invention no external power source is needed other than the agitation that is already present in the normal washing machine.

With the present invention no renewal parts such as batteries are needed.

With the present invention no renewal source of anything is needed such as chemical refills.

The present invention is simple and easy to use.

The present invention does not require a large bulky attachment; or external machine or process.

The present invention is not used up in the washing process.

The present invention is not discarded after the cleaning process.

Other laundry products which produce pleasant sensations to the human senses are compatible with the present invention. Appearance, feel, or odor enhancement products and process may be used and not interfere with the operation of the current invention. Whiteners, brighteners, softeners, or perfumes are completely compatible and may be used in conjunction if so desired.

Accordingly, the above objects and advantages are to provide a non polluting washing method and aid to be used many, many times rather than be discarded with each load of wash, resulting in improving our lives in many ways, including, having cleaner laundry, having less chemical residue to irritate sensitive skin, improving cleaning efficiency without increasing the damage due to abrasion, heat, and chemicals, newly exploiting a form of energy which is non-polluting, eliminating many disruptions in our lives such as running out of laundry detergent at inopportune times, conserving rather than waste and pollute our natural resources to a greater extent than heretofore possible.

The aforementioned objects and advantages of the invention, will, in part, become obvious from the following more detailed description of the invention, taken in conjunction with the accompanying drawings, which form an integral part thereof.

DRAWING FIGURES

The present invention will be more fully understood by reference to the following detailed description thereof when read in conjunction with the attached drawings, and wherein.

Figure 3A:
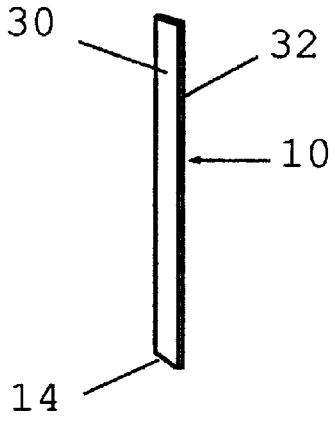
Figure 3B:
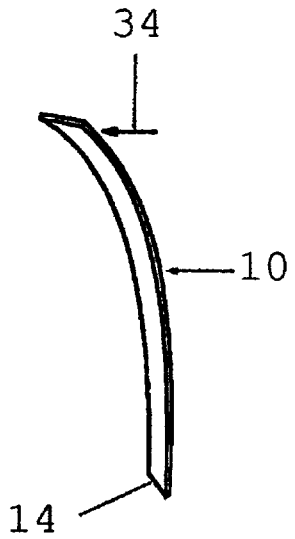
Figure 3C:
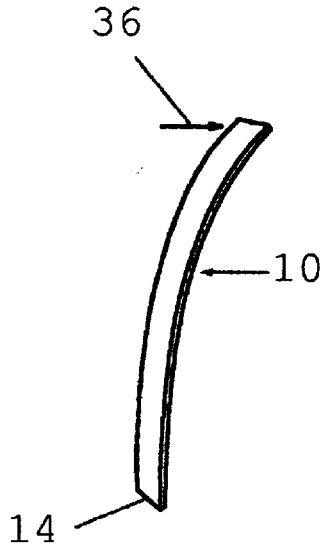
Figure 3D:
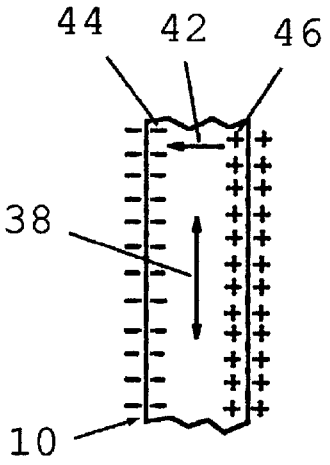
Figure 3E:
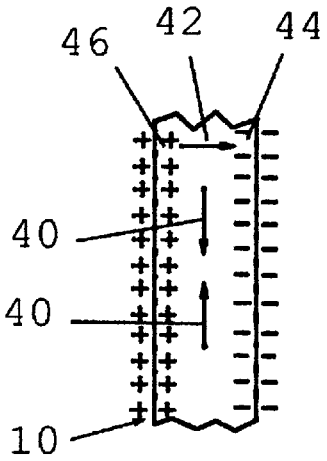
Figure 3F:
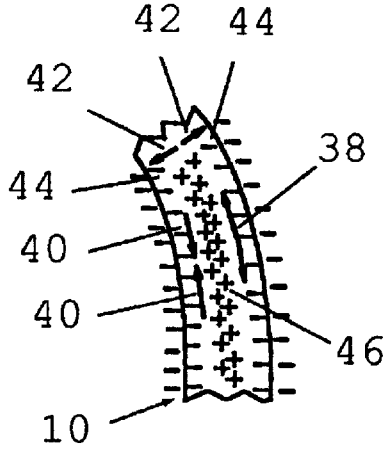
Figure 5:
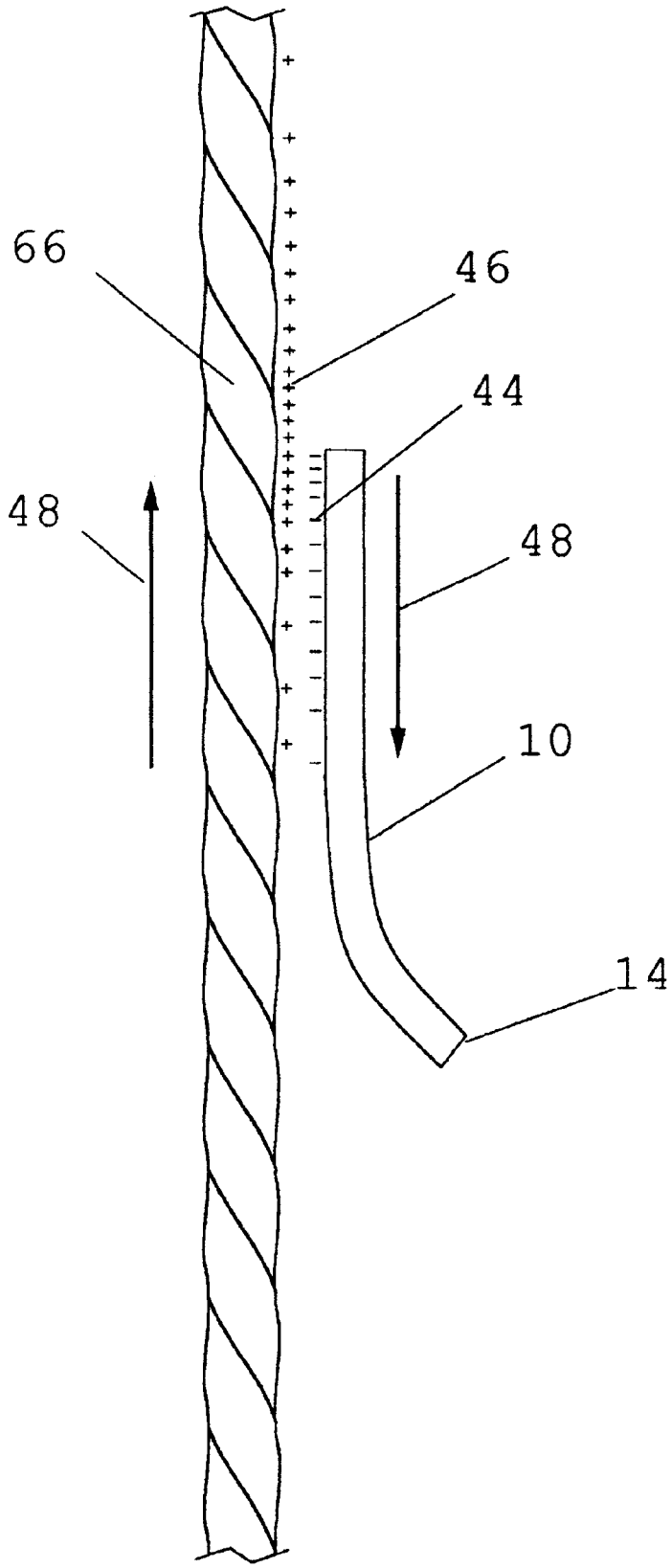
Figure 6:
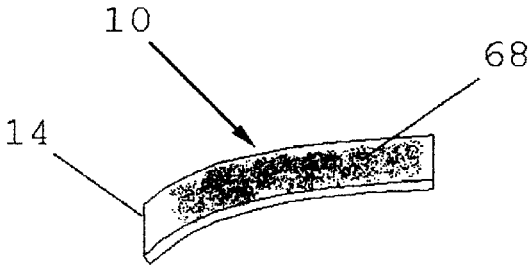
Figure 7:
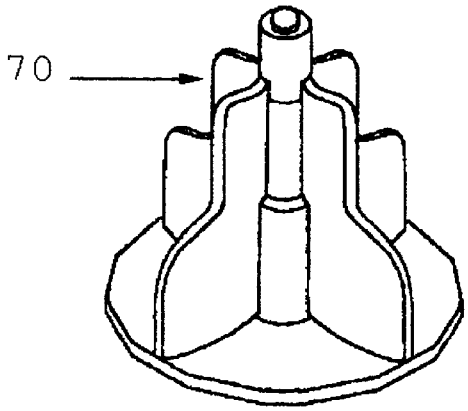
Figure 8:
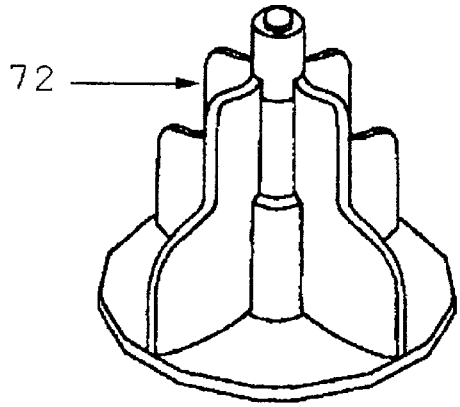
Figure 9:
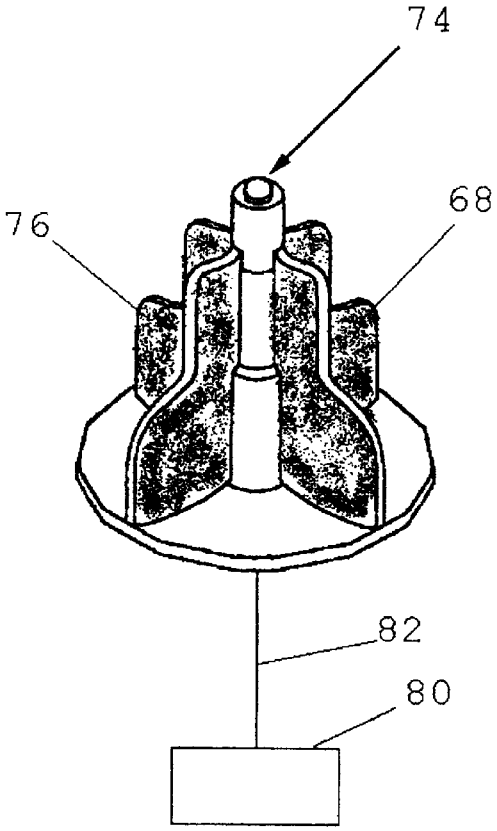
Figure 10:
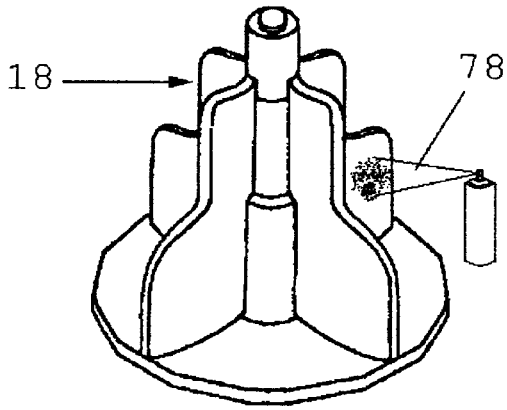

FIGS. 3A through 3F are edge views of piezoelectric charge generation according to the invention; FIGS. 3A through 3C are perspective views; FIGS. 3D and 3E are enlarged edge views; FIG. 3F is a cutaway edge view;

FIGS. 4A through 4E are perspective views of a third embodiment of a free floating laundry cleaning device according to the invention;

FIG. 5 is a schematic view illustrating the mechanism of frictional electric charge generation, distribution, and application powered by washing action;

FIG. 6 is a perspective view of a vital part of a preferred embodiment according to the invention;

FIG. 7 is a perspective view of a special design agitator of an alternate embodiment according to the invention;

FIG. 8 is a perspective view of a flexible agitator made of piezoelectric polymer or composite of another alternate embodiment according to the invention;

FIG. 9 is a perspective view of a single anode capacitative agitator according to the invention;

FIG. 10 is a perspective view of a spray on coating of a simple, yet practical embodiment according to the invention; and.

Figure 11:
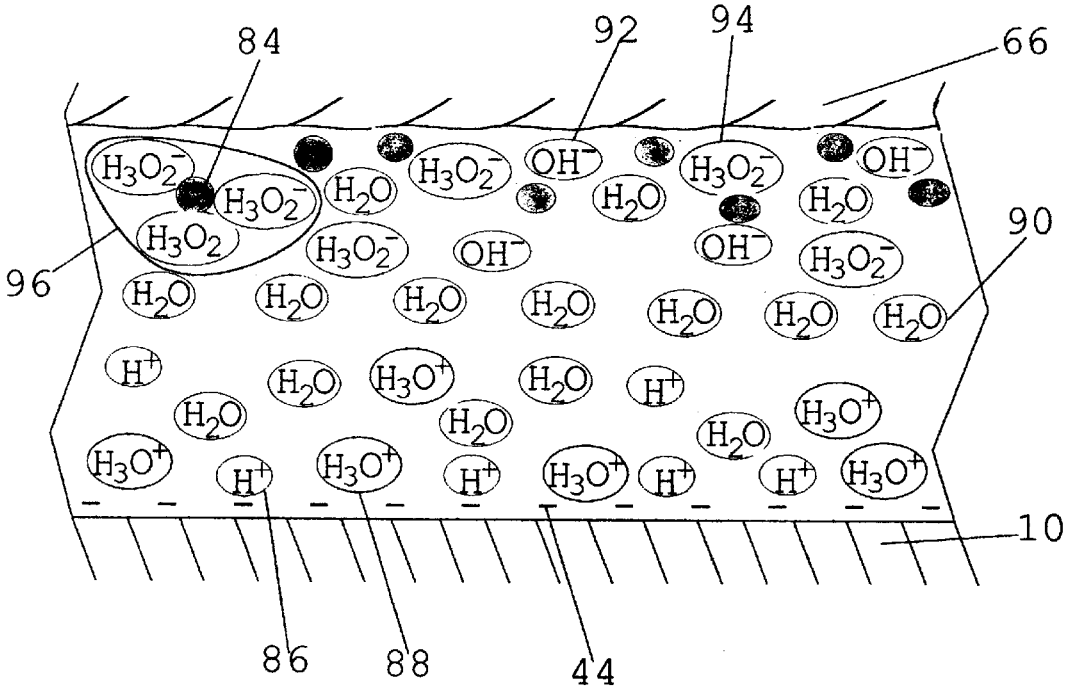

FIG. 11 is a magnified schematic view illustrating the separation of ions in water due to electric charge.

DRAWING REFERENCE NUMERALS

10 tine, nub, point, fin, flange, vane, filament, or elastomer (electric charge generating, distributing, and/or applying means)
12 surface
14 attached end or edge
16 attachment means
18 agitator of wash machine, (washing action imparting means)
20 fin of agitator
22 attachment ring
30 side
32 edge
34 left flex
36 right flex
38 tension
40 compression
42 internal electron movement
44 negative charge (electron concentration)
46 positive charge
48 direction of washing action movement generating friction
50 unattached device
52 bundle of elastomers
54 binder ring or wire
56 knot or tie
58 loose end of elastomer
60 tub of a washing machine
62 water, or washing fluid
64 item to be washed, article of clothing or fabric
66 fiber of cloth
68 surface chemistry detergent coating
70 agitator made out of special material
72 flexible agitator
74 capacitative agitator
76 plastic coated metal
78 spray on coating
80 electric charge generator
82 wire
84 soil, oil, dirt, micro organism, foreign matter
86 Hydrogen ions ($H^+$)
88 Hydronium ions ($H_3O^+$)
90 water molecules ($H_2O$)
92 Hydroxide ions ($OH^-$),
94 Hydroxyl ions ($H_3O_2^-$),
96 detergive attraction

SUMMARY OF INVENTION

According to this invention, there is provided a method of producing a cleaning effect comprising steps of converting mechanical energy into electrical energy, distributing electric energy in the vicinity of the location of the desired cleaning effect, and applying electric energy so as to provide the effect of cleaning, and there is provided inventive apparatus for implementing the inventive method. In accordance with the invention, mechanical energy, thermal energy, and chemical energy is supplemented by the energy of electric charge applied to effect the work of cleaning. Embodiments optionally comprise one or more of the features described in the following "Features of Invention."

FEATURES OF INVENTION

It may be helpful to the understanding of the invention to list many of the features.

A feature of the invention is the generation of electric energy to do the work of cleaning.

A feature of the invention is the distribution of electric energy to do the work of cleaning.

A feature of the invention is the application of electric energy to do the work of cleaning.

A feature of the invention is a surface chemistry detergent.

A feature of the invention is the modulation of the physical properties of a surface chemistry detergent by electric charge.

A feature of the invention is a method of cleaning laundry utilizing surface chemistry effects modified by electric charge.

A feature of the invention is a method of cleaning the environment utilizing surface chemistry effects modified by electric charge.

A feature of the invention is an anchored device for use inside an automatic laundry washing machine.

A feature of the invention is the application of electric energy in such a way as to effect cleaning by such phenomena as temporary chemistry changes or temporary physical changes in water.

A feature of the invention is a method of cleaning laundry utilizing the direct effects of electric charge (static and differential)

A feature of the invention is an unanchored device for use inside an automatic laundry washing machine.

A feature of the invention is a flexible surface, vane, or filament made of a frictioning material.

An example of such a material is extruded natural rubber.

A feature of the invention is a water treating processing means for the generating of hydroxide ions in wash and rinse water A feature of the invention is a water treating processing means for the generating of hydroxyl ions in wash and rinse water A feature of the invention is a water treating processing means for the generating of Hydronium ions in wash and rinse water A feature of the invention is increased cleaning time by being effective in cleaning during rinse cycles as well as the normal wash cycle of a standard automatic washing machine.

A feature of the invention is less injury to garments by elimination of the requirement for increased mechanical agitation time.

A feature of the invention is increased cleaning efficiency due to combined action of micro turbulence and non uniform ionic distribution.

The aforementioned examples of features of the invention, will, in part, become obvious from the following more detailed description of the invention, taken in conjunction with the accompanying drawings, which form an integral part thereof. Although the list above contains many features, these should not be construed as limiting the scope of the invention but merely as providing illustrations of some of the presently preferred embodiments of the invention. This list is not to be taken as a complete list, but as examples of many other features obvious to one versed in the art.

Therory of Operation

The Inventive Concept

It has long been known that water can be prepared for washing which has improved cleaning characteristics. Water can be heated then clothes washed in the heated water. The heat treated water remains effective for a duration of time on the order of minutes because it takes that much time for heat to dissipate. Water can be treated with chemical detergent then used for wash water. The time duration of the effectiveness of detergent treated water is days, or even weeks. Therefore, we have become accustomed to the idea of preparing wash water ahead of time, then washing clothes in the prepared water. That has been the failing of all prior art attempts to prepare ion enhanced wash water without chemical presence. Ionic treatment of water retains it's effectiveness (except for some very weak residual due to secondary effects) for a period of time of only a fraction of a second. It is not practical to enhance the ionic disassociation of wash water and expect it to stay that way in the absence of some force to keep the ions from recombining.

Applying ionic treatment to a batch of wash water, then washing clothes in it makes no more sense than applying kinetic energy (in the form of turbulence) to a batch of wash water then putting clothes in the settled water expecting the spent kinetic energy to clean the clothes. Even so, this is exactly the process that has been attempted many times over in the prior art attempts to ionically treat wash water. However, applying kinetic energy to wash water at the right time and right place is very effective in cleaning. In other words, turbulence really does clean clothes.

The practical effectiveness of kinetic energy in wash water lasts only a few seconds after application. The practical effectiveness of electric energy in wash water lasts only a fraction of a second after application.

The inventive concept is to apply this same philosophy to the application of electric energy that we apply to kinetic energy. The inventive concept is to apply the electric energy at the time and place where the cleaning is expected to occur.

Practical useful static electric fields do exist under water, even in highly conductive salty sea water. An example of this is the electric eel. These static fields do, however, have a short life because the conductivity of the water rapidly drains off the charge. One might argue that the water shorts out the field. However, that is exactly the desired result. As the electric charge of the invention is dissipated in the water in the vicinity of the soiled clothes, it does the work of cleaning. This inventive concept is a revolution in the theory of cleaning.

The friction of rubbing two dislike solid substances gives rise to the transfer and dislocation of electrons from the surface of one substance to the surface of the other. The movement of the rubbing further dislocates the excess electrons on the surface of one material from the depletion of electrons on the surface of the other. In the presence of low conductivity, electric charge builds up. In the presence of high conductivity, the electrons flow back to regions of the opposite charge. In the case of washing as in the invention, conductivity is low enough that some charge builds up, balanced by some flow of electrons to equalize the charge. While in the presence of the built up charge, the ions of the water are also displaced as they take place in the flow of electrons to neutralize the charges. This displacement of ions in the water give rise to an increase in the natural ionic dissociation of the water and an increase in the concentration of those naturally occurring ions having detergency.

The effect of electric energy on water to do the work of cleaning is powerful, but short lived. Where previous attempts of the prior art lacked sufficiency of effect was the failure to apply the energy in sufficient quantity at the location and time the work of cleaning was to be done. In the batch process of preparing the water then washing with prepared water, the effect was so diminished by the time the cleaning was attempted that it was like heating water to do the washing, then waiting for it to cool down before using it. This problem is overcome in the method of the present invention by the application of the electric energy at the same time and location where the kinetic energy of the scrubbing action is taking place The Cleaning Process A practical working prior art description of the cleaning process is found in Publication No. 348 published by The New Zealand Department of Agriculture, Ruakura Agricultural Research Centre, Hamilton, New Zealand.

> "The aim of the cleaning process is to provide sufficient energy to a system to change soil adhered to a surface into a suspended or dissolved state. Soil is held to surfaces by occlusion in surface interstices, by electrostatic forces between surface and soil and by the attraction of soil fractions for each other, . . . The sum total of all these forces may be expressed as the energy of soil adhesion. The energy in a cleaning solution is made up of the kinetic energy of the solution provided by turbulence, the thermal energy provided by solution temperature and the chemical energy provided by the constituents of a detergent. All three factors are related and it is possible by careful adjustment of one component to overcome limitations of either one or both of the other components."

Cleaning is work. In prior art discussions of cleaning this is work that is done on soil by a combination of kinetic energy, thermal energy, and chemical energy. Kinetic energy is in the form of turbulence. Thermal energy is in the form of elevated temperature. Chemical energy comes in two forms, chemical energy inherent in the chemical composition of water, and chemical energy in the form of detergent composition. Any form of energy that works to overcome the energy of soil adhesion to change soil adhered to a surface into a suspended or dissolved state does the work of cleaning. By careful manipulation of any one or more of these forms of energy, the work required to be done by any or all of the others can be reduced if not eliminated. For example, with more scrubbing, the requirement for hot water and detergent can be reduced. For another example, with the proper detergent, the need for higher temperature of the water can be reduced or eliminated. If another form of energy were found which contributed to the work of cleaning, that form of energy too could be manipulated to reduce or replace any or all of the other forms of energy to some extent.

An object of this invention is to effectively exploit another form of energy to do the work of cleaning.

The other effects of the work done in cleaning are to dissolve substances that are soluble such as sugar, or to melt substances such as grease, or sterilize by killing germs. Typically, the work done to dissolve substances is not the intention of chemical detergents. Dissolving is left to the natural chemical energy of water enhanced by thermal energy of hot water. Typically the melting of substances is not enhanced by chemical detergents, but again as in dissolving, melting is done by the natural thermal energy of hot water. Historically, the work done to sterilize laundry was accomplished by the thermal energy of hot water. Recently, without hot water, sterilization is left to be done by the heat of the dryer, or done by the addition of a chemical poison which remains in the waste water as a pollutant. Sterilization is not done by the chemical detergents, some of which are actually fertilizers, enhancing the growth of fungus or bacteria.

Other Laundry Related Processes

Processes other than cleaning are related to the laundering of clothes. Sterilization, fabric softening, static elimination, odor control, appearance related non-cleaning such as whitening and brightening and other processes obvious to one versed in the art of laundering are all processes that apply energy to do the work involved. In the past, various forms of energy were utilized. For example, radiant energy from the sun or ultra violet lamps, or thermal energy from hot water were used for sterilization. In recent times, chemical energy is the dominant form of energy used in such processes.

The chemical detergent companies would like us to believe that shifting the work of cleaning and other related processes toward the chemical form of energy is desirable. We have been taught that we do not need hot water to clean clothes. We have been taught that this saves energy and is good. This is because chemical energy can replace the thermal energy of hot water to lower the surface tension and thereby clean the clothes without the need for hot water.

However, when we changed the standard method of cleaning clothes to eliminate the hot water, the sterilization work of the heat energy was eliminated. The work of chemical energy again came to the rescue. The work of chemical energy replaced the work of thermal energy by the addition of chemical poisons to sanitize the laundry. In the saving of energy in the thermal form, energy in the chemical form was substituted. The main effect of this substitution of the chemical form of energy for other forms of energy is not the saving of energy, but is the pollution of the environment.

Evaluation of Effect

The major objection to the electrical treatment of water is not in the observations of the users not seeing cleaning being done, but in the lack of scientific explanation or lack of understanding of any underlying mechanism commonly accepted in the scientific community. Some scientists would assume that because no chemical detergent was added to the water that no detergency action resulted. This is an erroneous assumption. Therefore a dogmatic scientist, in not understanding how or why it worked, would say it did not work and was a fraud. That is like a blind person turning on a light switch and not detecting a light going on would say that electric lighting was a fraud. Since practically no scientist can completely explain why electricity would produce light, a blind scientist would conclude that electricity does not produce light. Those who actually benefit from the light have no problem with the lack of a complete explanation of why. In the same way, those who actually benefit from the clean clothes without the use of chemical detergent do not have a problem with the lack of scientific explanation for how it works. That is, they don't have a problem until some dogmatic scientist who does not understand it tells them it is a fraud. Then, not wanting to appear to be a fool, suddenly have a problem telling someone that their clothes actually got clean.

In other words do clothes in a batch of general household laundry get clean without chemical detergent? Be careful here how you define clean. By clean we mean the removal of soil or contaminants. In judging the results of any tests be careful not be fooled by the addition of chemical contaminants that fool the eye into thinking laundry is cleaner. Chemical agent whitener is added by some detergent manufactures, and the chemical detergent may even be weakened to prevent the detergent from removing the whitener. Clothes washed in this product appear to be whiter but do not remove very much (if any) more contaminants than washing in plain water. The whiteness of the laundry washed in this product can be removed by immediate repeated multiple washings in plain water after washing in this product.

It is suggested that the user of a detergent run an experiment by washing some white towels with stains in their favorite detergent. Save one of the clean towels out and wash the others over again a couple of times in water alone. When you compare the results of the multiple washes, see for yourself that the whitener of the detergent is washed out. The towels washed extra times in plain water will have the whitener chemical removed leaving a cleaner, yet less white towel.

If this whitener is desired, it can be added without the use of a chemical detergent, but should not be confused with cleanness. The same is the case with the addition of chemical brighteners. The results of chemical brighteners should not be confused with cleanness. Chemical brighteners too can be added to the cleaning process if desired, without sacrificing the environment by the addition of chemical detergent. In addition to whiteners and brighteners, there are fabric softeners and perfumes to give the clothes the feel and odor we associate with cleanness. There are also germicides and fungicides, which are actually chemical poisons to sterilize the laundry. Whiteners, brighteners, fabric softeners, perfumes, germicides and fungicides are actually the addition of foreign substances to the laundry, rather than the removal of foreign substances from the laundry. If these additives are desired to give the laundry the appearance, feel and odor of cleanness, they can be added without adding the chemical detergent.

With the scientific explanation for the present invention being so straight forward and documented, that problem with the blind dogmatic scientist has gone away. Now there is a scientific explanation of how electric fields are generated in substances like plastic or rubber and how electric fields from such substances produce reactions in the water, and how the reactions in the water are related to cleaning of laundry, and why there is no detectable difference in the water before and after the treatment of the water which is effective only during the cleaning process, leaving no residual effect. This lack of residual difference in the water which is a stumbling block to the doubting scientist, is not a weakness, but is the most desired effect sought after in the quest to keep the environment pollution free.

Many tests and demonstrations have been performed demonstrating the effectiveness of the invention.

Theoretical Basis

It may be helpful to understand the theory behind some features of this invention. While we believe this theory to be valid, we do not wish to be limited thereto as other considerations may be pertinent. The validity of the invention has been empirically established. Several effects will be explained.

Electrically Induced Detergency

The Matsuoka Experiment

Takahisa Matsuoka and Mutsuo Iwamoto describe the effect on surface tension and permeability due to the electrical treatment of water in an experiment described in the Japanese Journal of Food Science and Technology, Nippon Shokuhin Kaogyao Gakkaishi, Volume 38, No. 5, 1991, pages 422–424. The article is entitled "Surface Tension and Permeability of Water Treated by Polar Crystal Tourmaline." In the experiment, water was electrically treated using the electrically polar crystalline substance tourmaline. The treated water, which started out with a normal surface tension of approximately 65 dynes per centimeter, had a surface tension of approximately 50 dynes per centimeter immediately after treatment. The surface tension reduction was a temporary effect and returned to normal after a few minutes. After returning to normal, the water had no detectable difference in any properties from before the treatment. The electrical treatment did not result in any permanent change in the water any more than water which has been heated and then cooled back down is any different than water that has never been heated. The results of the experiment can be summarized by saying that just like water that has been heated has lower surface tension, water that has been electrically treated has lower surface tension, neither has any permanent detectable effect.

However, in the Matsuoka experiment, there is a discrepancy between the effect on distilled water and city tap water. The water containing impurities had a greater measured effect and retained the effect longer in time. This discrepancy gives a clue to the reason the ionic separation lasted even long enough to be measured. It appears that the effect was much greater immediately upon treatment in the immediate vicinity of the electric charge, and was preserved by the detergency attachment to impurities in the water. More impurities in the water resulted in greater accumulation of effect, and longer duration of effect. This effect of impurities causing electrically treated water to retain detergency longer is explained by the chemical formulas in the next section. Even so, the effect measured immediately after accumulating a batch of treated water was only on the order of half the effect of chemical laundry detergent. The water treatment process used in the Matsuoka experiment is very slow. The treatment of water by the electrically polar crystalline substance tourmaline requires much longer time to fill up one washing machine tub than the effect lasts. This yields this process of batch treatment before use as impractical as a laundry solution. In the current inventive method the treatment is done simultaneously with the work of cleaning and in the same location as the work of cleaning is being done.

This temporary reduction in surface tension in this experiment is significant, because water that has had it's surface tension lowered by the addition of chemical detergent does have a permanent change that can be measured in the waste water. It has chemical pollutant which in many cases would not be allowed to be discharged if it were from an industrial plant.

Hypothetical Explanations

Several hypotheses have been proposed to explain the increase in the effectiveness of the physical property of detergency when water is treated electrically. One hypothesis uses dissolved oxygen, another the liberation of hydrogen, another the disassociation of water only with no gain or loss of hydrogen or oxygen. Which hypothetical mechanism is in operation may depend on the voltage and current conditions of the electric charge or some other factor, but the net results are the same: Temporary detergency is induced into the water, and impurities prevent the induced detergency from immediate dissipation. Two of the hypothesis have been herein expanded in detail sufficient for one versed in the art to develop others.

Hypothesis 1: Dissolved Oxygen In Water

In the washing machine are water ($H_2O$), oil, cloth, and an embodiment of the current invention.

In the washing machine the agitator causes kinetic energy to do the work of whipping air, containing Oxygen ($O_2$), and oil into the water ($H_2O$).

$$H_2O+O_2+\text{Oil}$$

The water is naturally, weakly disassociated into Hydrogen ions ($H^+$) and Hydroxide ions ($OH^-$), and Oxygen ($O_2$) is naturally dissolved.

$$6(H_2O)+O_2+\text{Oil}\leftrightarrows 8(H^+)+4(OH^-)+4(O^=)+\text{Oil}$$

With the introduction of an electric charge into the water by an embodiment of the current invention, the Hydroxide ions ($OH^-$) are repelled by the negative charge and the Hydrogen ions ($H^+$) are attracted to the negative charge, and vise versa for the positive charge. Thus the energy of the electric charge does the work of spatially separating the Hydrogen ions ($H^+$) from the Hydroxide ions ($OH^-$) where the Hydrogen ions ($H^+$) combine with dissolved oxygen ($O^=$) and the Hydroxide ions ($OH^-$) having the physical property of detergency attach themselves to the oil, resulting in an oil water emulsion.

$$8(H^+)+4(OH^-)+4(O^=)+\text{Oil.}\rightarrow 4(H_2O)+(4(OH^-)+\text{Oil})$$

The total reaction in the presence of electrical charge driving the arrows to the right being:

$$6(H_2O)+O_2+\text{Oil}\rightarrow 8(H^+)+4(OH^-)+4(O^=)+\text{Oil.}\rightarrow 4(H_2O)+(4(OH^-)+\text{Oil}).$$

The first arrow is by natural dissociation. The second arrow is by the work of electrical charge energy.

With the removal of the electrical charge, the source of energy driving the second arrow to the right, the wash water slowly returns to the natural state, being slowed by the attachment of the Hydroxide ions ($OH^-$) to the oil.

$$6(H_2O)+O_2+\text{Oil}\leftarrow 8(H^+)+4(OH^-)+4(O^=)+\text{Oil.}\leftarrow 4(H_2O)+(4(OH^-)+\text{Oil}$$

After the removal of the source of electrical energy the duration of time for the return reaction being on the order of approximately an hour to approximately three hours is sufficient for the water and soil emulsion to be rinsed out of the wash machine. This is of the same order of magnitude time as the cooling time for hot water to return to ambient temperature once the source of thermal energy is removed.

As the emulsion separates the water returns to it's normal composition and the water looses it's detergency, the soil held in suspension separates from the water and settles out, aiding the natural process of purifying the water as it is returned to the environment.

Hypothesis 2: Disassociation Of Water Only

In the washing machine are water ($H_2O$), oil, cloth, and an embodiment of the current invention.

$$H_2O+Oil$$

Naturally, water is weakly disassociated into Hydrogen ions ($H^+$) and Hydroxide ions ($OH^-$).

$$(H_2O)+Oil \leftrightarrows (H^+)+(OH^-)+Oil$$

With the introduction of an electric charge into the water by an embodiment of the current invention, the Hydroxide ions ($OH^-$) are repelled by the negative charge and the Hydrogen ions ($H^+$) are attracted to the negative charge, and vise versa for the positive charge. Thus the energy of the electric charge does the work of spatially separating the Hydrogen ions ($H^+$) from the Hydroxide ions ($OH^-$). The Hydrogen ions ($H^+$), being spatially separated from the Hydroxide ions ($OH^-$) due to the work done by the electric charge of an embodiment of the current invention, combine with other water molecules ($H_2O$) forming Hydronium ions ($H_3O^+$).

$$(H_2O)+(H^+)\rightarrow(H_3O^+)$$

Meanwhile, the Hydroxide ions ($OH^-$), being spatially separated from the Hydrogen ions ($H^+$) due to the work done by the electric charge of an embodiment of the current invention, combine with other water molecules ($H_2O$) forming Hydroxyl ions ($H_3O_2^-$).

$$(H_2O)+(OH^-)\rightarrow(H_3O_2^-)$$

Hydronium ions ($H_3O^+$), and Hydroxyl ions ($H_3O_2^-$), being spatially separated from each other due to the work done by the electric charge of an embodiment of the current invention, and each having the physical property of detergency attach themselves to the oil, resulting in an oil water emulsion.

$$(H_3O^+)+Oil\rightarrow(H_3O^++Oil)$$

$$(H_3O_{2-})+Oil\rightarrow(H_3O_2^-+Oil)$$

The total reaction in the presence of electrical charge driving the arrows to the right being:

$$3(H_2O)+Oil\rightarrow 2(H_2O)+(H^+)+(OH^-)+Oil\rightarrow(H_3O^+)+Oil+(H_3O_2^-)\rightarrow (H_3O^++Oil)+(H_3O_2^-+Oil)$$

The first arrow is by natural dissociation in the abundance of water ($H_2O$ ) driven right by the removal of Hydrogen ions ($H^+$) and Hydroxide ions ($OH^-$) from the right side of that equation by the second arrow. The second arrow is by the work of electrical charge energy. The third arrow is driven right by the detergency physical property of Hydronium ions ($H_3O^+$), and Hydroxyl ions ($H_3O_2^-$) and the abundance of Hydronium ions ($H_3O^+$), and Hydroxyl ions ($H_3O_2^-$) due to the work of electrical charge driving the second arrow to the right.

With the removal of electrical charge, the source of energy driving the second arrow to the right, the wash water slowly returns to the natural state, being slowed by the attachment of Hydronium ions ($H_3O^+$), and Hydroxyl ions ($H_3O_2^-$) to the oil.

$$3(H_2O)+Oil\leftarrow 2(H_2O)+(H^+)+(OH^-)+Oil\leftarrow(H_3O^+)+Oil+ (H_3O_2^-)\leftarrow(H_3O^++Oil)+(H_3O_2^-+Oil)$$

After the removal of the source of electrical energy the duration of time for the return reaction being on the order of approximately an hour to approximately three hours is sufficient for the water and oil emulsion to be rinsed out of the wash machine. This is of the same order of magnitude time as the cooling time for hot water to return to ambient temperature once the source of thermal energy is removed.

As the emulsion separates the water returns to it's normal composition and the water looses it's detergency, the soil held in suspension separates from the water and settles out, aiding the natural process of purifying the water as it is returned to the environment.

Micro-Turbulence

Surface tension prevents water from penetrating the micro interstices of cloth to remove the soil particles entrapped therein. Turbulence reduces this effect of surface tension by forcing water into and out of smaller spaces. Micro-turbulence is induced in water by static electric charges. Water is attracted to a charge opposite that contained in the water, and repelled by a like charge. An experiment was done with a comb run through hair to gain a static electric charge. The charged comb was then brought near a cup of water filled to the point of overflowing prevented only by surface tension. A camcorder was positioned like a microscope to record the effect. As the charged comb was brought near the water, a small droplet of water, in less than one fifteenth of a second, overcoming the surface tension, jumped toward the comb, but never touched the comb. As the droplet approached the comb, charge was transferred to the water so that the charge on the water droplet became the same polarity as the comb and the droplet was immediately repelled by the charge remaining on the comb. It is believed that this process is present in the froth of air and water in the immediate vicinity of the electric charge distributing means of the current invention. This rapid moving back and forth of the water on a scale smaller than that of the droplets formed by surface tension, is called micro-turbulence. This effect is especially probable where the oscillating action of the agitator causes one polarity charge to be produced by movement in one direction and then the opposite polarity charge to be produced in the other direction, resulting in the article of clothing in the immediate vicinity of the electric charge distributing means of the current invention to have the opposite polarity charge as the electric charge generating means of the current invention.

Of the two types of turbulence, micro turbulence is more on the size scale of the interstices of the cloth in which the soil is entrapped. Another example of micro turbulence is the turbulence induced by ultrasonic sound energy in ultrasonic cleaning. Both are the result of an outside source of energy doing the work of overcoming the energy of surface tension.

Direct Electrostatic Effect

The forces that hold soil to surfaces includes electrostatic forces. Soil is held to surfaces by occlusion in surface interstices, by electrostatic forces between surface and soil and by the attraction of soil fractions for each other. The sum total of all these forces may be expressed as the energy of soil adhesion. Since electrostatic forces are included in the forces of attraction, and since opposite forces attract and like forces repel, electrostatic forces have a direct effect in overcoming those electrostatic forces of soil adhesion. It is hypothesized that in the immediate vicinity of the electric charge distributing means of the current invention this energy of soil adhesion is overcome by work expended by the electric charge energy of the current invention.

Surface Tension

Surface tension is the force which causes water to have self attraction. Surface tension is the force which prevents water from entering small interstices of cloth that has not been prewetted. Surface tension causes water when slowly exiting a capillary tube to form up into a ball until the forces of attraction of water for itself are overcome by the force of gravity causing the ball of water to drop. A commonly accepted method of measuring the force of surface tension is called the drop weight method, or drop volume method. I have constructed a relative surface tension meter based on a variation of that method. I call it the drop count or drop frequency method. The device forces one ml of fluid through a steel capillary tube in four minutes. (It is driven by a clock mechanism which turns once in sixty seconds.) The reciprocal of the time between drops gives the number of drops in one ml. The number of drops per ml. is inversely proportional to the surface tension. With the relative surface tension meter, normal tap water at room temperature drops approximately every four seconds, yielding 58 drops per ml. When water is mixed with a popular brand of laundry detergent in a wash machine according to the proportions directed on the container, the relative surface tension meter yields 132 drops per ml., indicating less than half the surface tension of normal tap water. However, in measuring normal tap water at room temperature, while dropping approximately every four seconds, connecting a high voltage static electric charge to the steel capillary tube causes the drop size to so drastically decrease as to raise the drop rate to between 1200 and 1400 drops per ml. That is a approximately one twentieth the size of drop formed by the same water the instant before the electric charge is connected and the instant after the electric charge is disconnected. Stated another way, the electric charge affects the surface tension ten times as much as the laundry detergent. The experiment was repeated using the electric charge of a plastic comb run through my hair and brought near the forming drop. The effect was of a similar order of magnitude.

Permeability

Permeability is a measure of the ability of water to pass through material which is prewetted to remove surface tension effects. The Matsuoka experiment demonstrated that related to the reduction of surface tension due to electrical treatment is also an increase of permeability, a reduction of the resistance of water to flow through the interstices of prewetted cloth.

Surface Chemistry Detergency Modulated by Electric Charge

An inventive feature of this invention is the use of a surface chemistry detergent. Surface chemistry detergent is a solid having detergent molecules attached to the surface of the solid, possibly by chemical bonding. Alternately the detergent molecules are an integral fraction of the solid with the detergent molecules at the surface extending out and attached at only one end. Examples of surface chemistry molecules having detergency are long polymer string molecules terminated at the free end with a terminal benzoic acid group conjugated to a piezoelectric polymer. This gives the surface the physical characteristic of attracting and holding soil particles by molecular bonding.

Another inventive feature of this invention is the use of electric charge to modulate the attraction of a surface chemistry detergent. This modulation is performed by reversing the electric charge at the terminal end of the detergent molecule by exploiting the electrical properties of the main bulk of the solid. As shown in FIG. 3D, FIG. 3E, and FIG. 3F, in the case of a main bulk containing a piezoelectric polymer, flexing the main bulk of the solid in one direction makes the whole bulk negatively charged, and flexing the main bulk of the solid in the other direction makes the whole bulk positively charged. Alternatively, stretching the main bulk makes one side positive and the other side negative. In either case, the surface with the detergent molecule has a reversing polarity electric charge which modulates the detergency properties. When stretched or flexed in one direction, the molecule attracts and holds soil by virtue of the molecular characteristic of hydrophobic attraction. When relaxed or flexed in the other direction the molecule releases the soil into the charged water where it is held in suspension or emulsion by the temporary detergency properties of water having been charged by the charge draining off the same surface. Think of it as a rubber band which when stretched by being dragged past a particle of soil on an article of clothing, attracts and holds that particle until the agitator reverses and the rubber band snaps back ejecting the soil particle into the water along with electric charge which gives the water the physical property of detergency to hold that particle until the water is drained from the washing machine. As explained elsewhere herein, the detergency physical property induced into the water by the electric charge is temporary and after a short period of time the soil will automatically separate from the discarded wash water leaving clear non polluting water to return to the environment, thus filling that long recognized and unfilled need for reducing laundry chemical waste which is polluting the environment.

A material having piezoelectric properties produces an electric charge when flexed, then produces an electric charge of the opposite polarity when flexed the other direction. Piezoelectric polyvinylidene fluoride (PVDF) is an example of such a substance. Other examples are composite materials too numerous to list.

Piezoelectric polyvinylidene fluoride (PVDF) is an example of a plastic substance having piezoelectric properties:

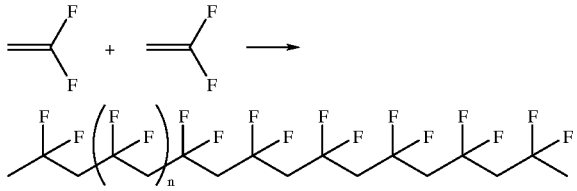

Such a substance or a copolymer is synthesized with the added physical property of surface molecular attraction detergency due to hydrophobic attraction. The object of the synthesis is to attach a detergent type molecule to a piezoelectric polymer such as PVDF or to make a copolymer that acts to break up surface tension of water and attract grease or soil particles in a way similar to existing chemical additive detergents.

General Scheme: (Protected Amine is One Example of Possible Chemical Synthesis)

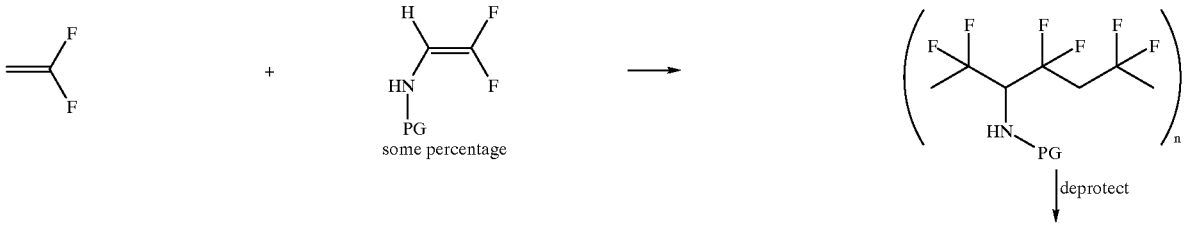

-continued

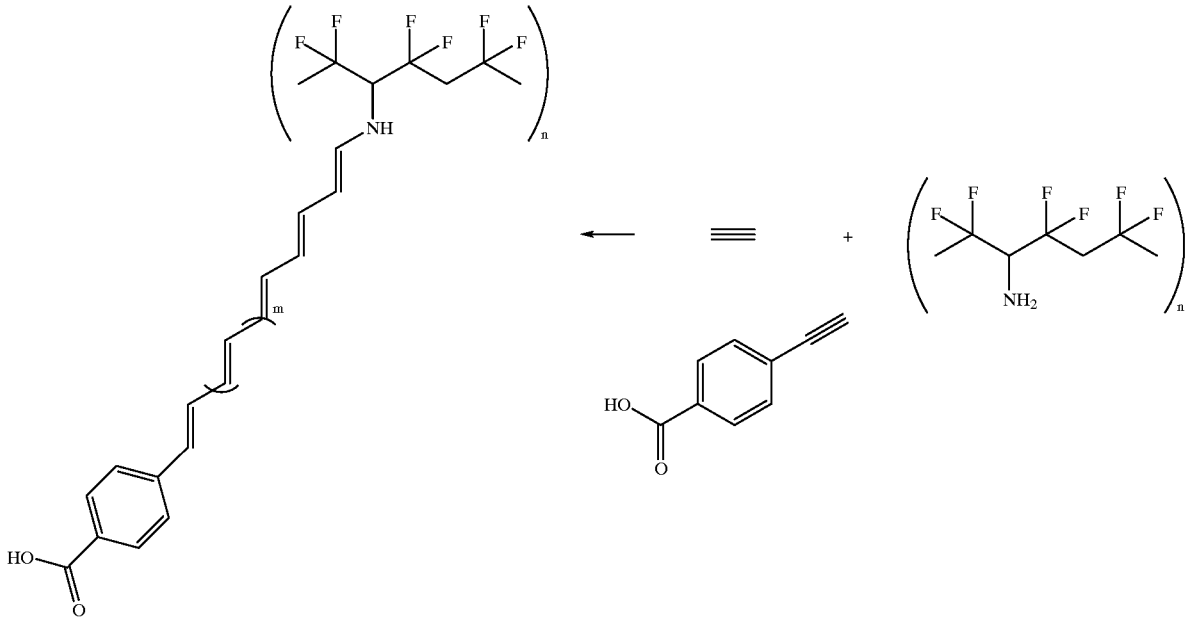

The resulting copolymer with a terminal benzoic acid group conjugated to the piezoelectric polymer results in alternating negative (deprotonated) and neutral (protonated) charges upon mechanical agitation. This alternating charge breaks the surface tension while the long conjugated greasy part of the molecule attracts soil by hydrophobic attraction, then alternatingly, by the opposite charge overcoming the molecular hydrophobic attraction, releases the soil as fine particles into the wash water to be held in suspension or emulsion until rinsed away.

DETAILED DESCRIPTION OF THE PREFERRED EMBODIMENTS

As will become obvious, there are multiple preferred embodiments of the present invention. In general, each embodiment has a body such as a central core, or an agitator, and external parts more resembling fins which sometimes flex, or sometimes a flange which rubs without flexing. The body is usually a mass with inertia, and the fins are points or areas of application of the electric energy to the process of cleaning.

Figure 1A:
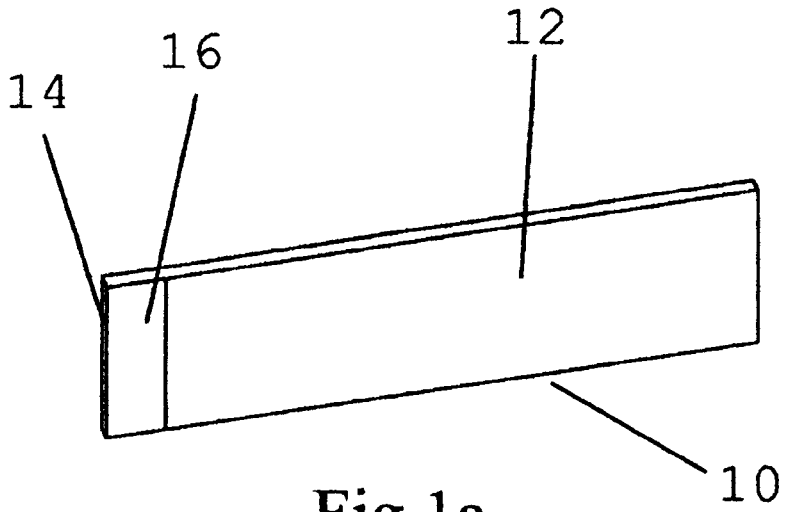
FIGS. 1A and 1B are perspective views of a first embodiment of a laundry cleaning device according to the invention, directly coupled to an agitator.
Figure 1B:
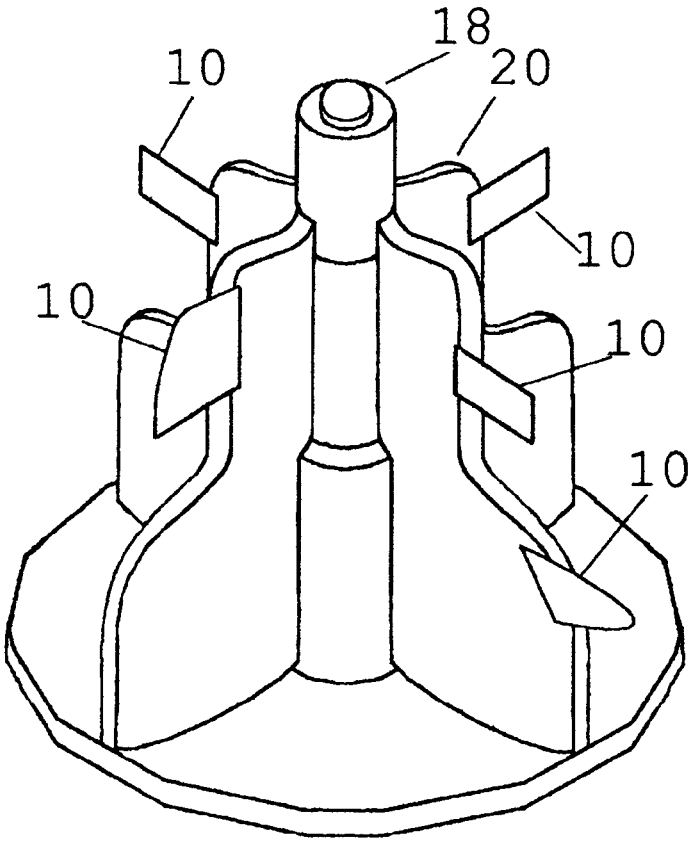

First Embodiment—FIGS. 1A and 1B Direct Attachment to Agitator

FIGS. 1A and 1B illustrate a first embodiment of the present invention. In this embodiment there is direct attachment to a source of kinetic energy, and electric energy is generated using the principle of piezoelectricity.

Generally at 10 is an external part 10, which is a tine, nub, point, fin, vane, filament, or elastomer. Throughout the descriptions of the figures, this part, fin 10, takes on various forms and is made of various materials having various characteristics. This part, fin 10, functions as a means for generating, distributing, and/or applying of electric charge. As long as the function and general appearance remain the same, this item 10 will be referred to with the number 10. Fin 10 of this first embodiment is made of material having a physical property of piezoelectric electric charge generation. An example of such a material is piezoelectric polyvinylidene fluoride (PVDF). The molecular structure of PVDF is described above in the section on theoretical basis. Fin 10 of a first embodiment of the invention has a width dimension which is much greater than a thickness dimension such that fin 10 will flex more readily in the width plane than in the thickness plane. An attached end or edge 14 has an attachment means 16 such as a conventional adhesive, weld, or clamp. Attachment means 16 secures fin 10 to an agitator 18 of a conventional clothes washing machine (not shown.) FIG. 1B shows a plurality of fins 10 of various shapes attached to agitator 18 in various locations on agitator 18. A plurality of fins 10 are attached to agitator 18. When a conventional washing machine (not shown) applies a washing action by agitation action of agitator 18, such washing action moves the fins against water (not shown) and against clothes (not shown.) This causes fins 10 to flex, generating electric charge and distributing electric charge in the vicinity of the clothes (shown.elsewhere herein)

Figure 2A:
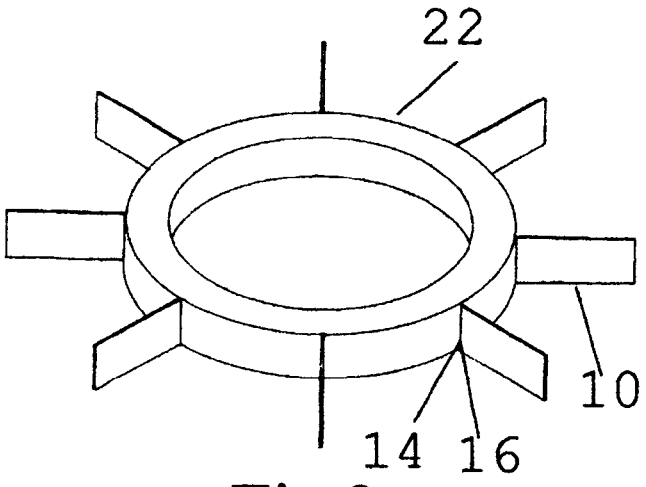
FIGS. 2A and 2B are perspective views of a second embodiment of a laundry cleaning device according to the invention, indirectly coupled to an agitator.
Figure 2B:
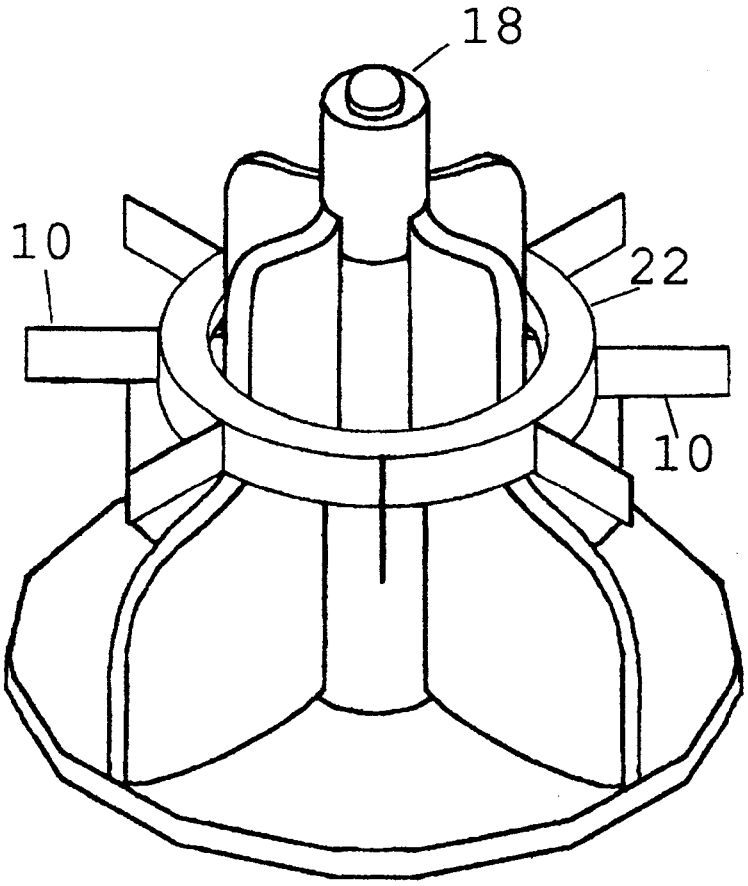

Second Embodiment—FIGS. 2A and 2B Indirect Attachment to Agitator

FIGS. 2A and 2B illustrate a second embodiment of the present invention. In this embodiment there is indirect attachment to a source of kinetic energy, and electric energy is generated using the principle of piezoelectricity. In this embodiment fins 10 are attached to an intermediate device 22 which in turn secures fins 10 to agitator 18. Intermediate device 22 is removable from agitator 18. Filaments or fins 10 made of material having a physical property of piezoelectric electric charge generation, as in the first embodiment described above, are attached by conventional attachment means 16 to a donut shaped ring 22 which fits around agitator 18 of a conventional washing machine (not shown.). An attaching device 22 can be made of various designs as would be obvious to one versed in the art. In the case illustrated in FIGS. 2A and 2B, ring 22 is made from a flexible material of shape and form similar to a donut with a large hole through which agitator 18 snugly fits. An example of such a material is conventional clear polyvinyl chloride (PVC) tubing formed into a ring of a size appropriate to fit on agitator 18. The back and forth washing action of agitator 18 flexes fins 10 back and forth as fins 10 move against the water and clothes in the washing machine.

Piezoelectric Charge Generation—FIGS. 3A Through 3F

FIGS. 3A through 3F illustrate piezoelectric electric charge generation. Each figure is an edge view of fin 10 made of material having a physical property of piezoelectric electric charge generation. FIG. 3A shows fin 10 having a broad side 30 and a narrow edge 32 and having one end attached 14. FIG. 3B shows fin 10 having a left flex 34. FIG. 3C shows fin 10 having a right flex 36. In use the flex alternates between right and left. FIGS. 3D and 3E are edge views of a fin 10 type part illustrating a conventional prior art use of a similar piezoelectric material used to convert kinetic energy to electric energy as in, for example, the generation of electric power from the action of ocean waves. In FIG. 3D, depending on the alignment of the piezoelectric properties, an applied tension 38 results in an internal electron movement 42 to the left resulting in a negative electric charge 44 on the left side and a positive electric charge 46 on the right side. In conventional electric generation use, a conventional conductor (not shown) on each side of fin 10 leads the charge away as a current to do useful work elsewhere. In FIG. 3E, the same fin 10 is shown under compression 40. This compression 40 reverses the direction of internal electron movement 42 to the right, resulting in a negative electric charge 44 on the right side and a negative electric charge 46 on the left side, the opposite sides as in FIG. 3D. FIG. 3F illustrates this inventive use of material having a physical property of piezoelectric electric charge generation. An edge view of fin 10 is shown in the same orientation as in FIGS. 3D and 3E. However, the fin 10 of FIG. 3F is flexed such that compression 40 occurs on the left side, and tension 30 simultaneously occurring on the right side. This causes the internal electron movement 42 direction to be left near the left surface, and right near the right surface, resulting in a concentration of electrons near both outer sides of fin 10 when flexed left. The opposite positive charge is concentrated in the middle of the thickness of fin 10, the dielectric properties of the material of fin 10 preventing the flow of electrons to neutralize the charge. This negative charge on the outer surface of fin 10, being closer to the water (not shown) and clothes (not shown) surrounding fin 10 appears to this surrounding water and clothes to be the only charge, and thus has the desired effect as described in the preceding section entitled theoretical basis. When that same fin 10 is flexed in the opposite direction (not shown) the mechanism is similar, with reversal of the polarity to positive near the outer surface of fin 10. In either case, electric charge does the work of cleaning in the water as described in the preceding section entitled theoretical basis.

Third Embodiment—FIGS. 4A through 4E Inertial Coupling to Agitator

Figure 4A:
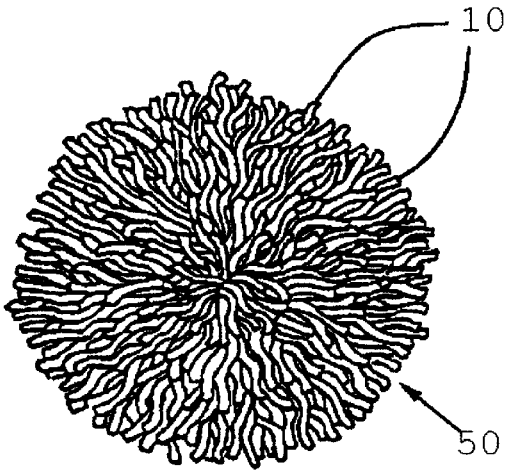
Figure 4B:
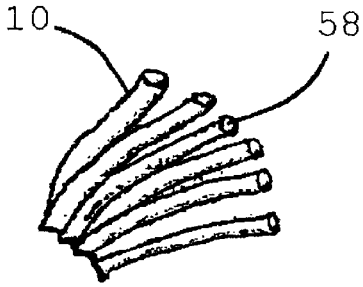
Figure 4C:
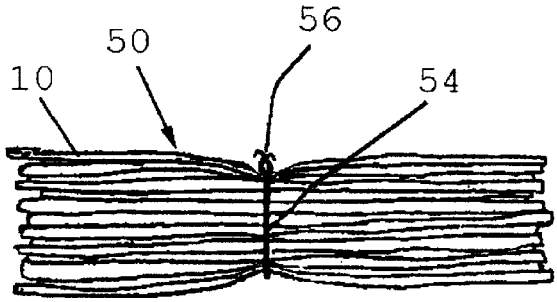
Figure 4D:
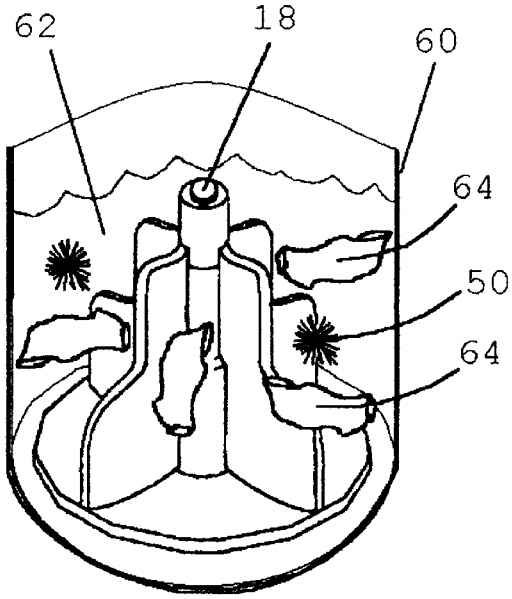
Figure 4E:
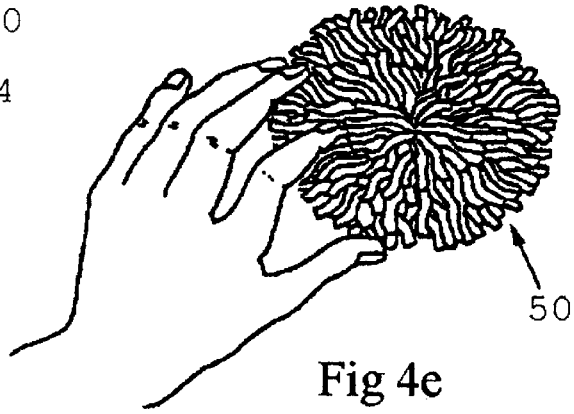

FIGS. 4A through 4E illustrate a third embodiment of the present invention. In this embodiment, an electric charge generating means, an electric charge distributing means, and an electric charge applying means are all integrated into one device. In this embodiment this device is an external part more resembling a filament 10. In this embodiment electric energy is generated using the principle of frictional electric charge generation. In this embodiment a great plurality of fins, vanes, filaments, or elastomers 10 are attached to a free floating unattached device 50. Filaments or fins 10 are made of material having a physical property of frictional electric charge generation. An example of such a material is extruded natural rubber. Free floating unattached device 50 is put into a tub 60 of a conventional washing machine (not shown) along with water or a washing fluid 62 and items of laundry 64. Kinetic energy is transmitted to unattached device 50 by the interaction of agitator 18, water 62, items of laundry 64, and device 50, in the presence of conventional agitation washing action, device 50 generates electric charge and transmits it directly to the immediate vicinity of the cleaning work being done by the kinetic energy, where the electric energy does work of modifying the physical properties of water to increase the naturally occurring detergency properties of water, as described in the above theoretical basis section. Alternatively, device 50 may be hand held as shown in FIG. 4E to be used as a scrubbing device for such diverse cleaning tasks as spot removal, bathing and shampooless hair cleaning.

FIG. 4A illustrates the general appearance of a third embodiment of a device constructed to be used in accordance with the invention. Device 50 is formed with a large plurality of elongate, floppy, elastomeric filaments 10, each of which, as is clearly evident in FIG. 4B, has cross-sectional dimensions of the loose ends 58 of filaments 10 which are extremely small in relation to the length of the filament. As will be more fully explained shortly, these filaments are joined in a central core region in such a manner that they radiate outwardly in a fairly uniform dense and bushy fashion, in multiple angularly offset planes to form a substantially spherical or ragged pompom like configuration. In this embodiment the central core region is the body as defined above. While the outside diameter of device 50 may be of any desired size, a very satisfactory diameter lies in the range of about 3 to about 10 inches.

While, to be sure, various techniques and devices may be used for joining these filaments to produce the desired resultant object, device 50 has been formed, as is illustrated in FIG. 4C. A large plurality of extruded rubber filaments are bundled and stretched to about three times their relaxed length. Next a conventional cinching device 54 is wound as illustrated around the mid point of the bundle and secured by a knot or twist tie 56. The stretched rubber filaments are then released, with the result that the stretched filaments spring back toward their gathered centers, with a natural tendency to fan out radially in all planes to have the substantially spherical form which is illustrated.

Clearly, device 50 is extremely simple and inexpensive in construction.

The specific nature of device 50 can be altered, of course by changing cross-sectional dimensions, cross sectional aspect ratios and specific materials employed for the filaments 10 and cinching device 54.

The material selected can have a piezoelectric characteristic in place of or in addition to a frictioning characteristic.

The device 50 can optionally have a conventional floatation device (not shown) attached or be made from material having a floatation characteristic for the purpose of achieving floatation just above neutral buoyancy such that device 50 floats with approximately 3 to 15 percent of its volume above the surface of water 62.

This device 50 can be used in a washing machine for washing clothes, or as a hand held scrubbing device as in, for example, shampooless hair cleaning.

When used in a washing machine, the floatation at nearly neutral buoyancy will allow the device to occasionally be drawn under the surface of water 62 as agitator 18 turns the clothes over with it's scrubbing action. The action of agitator 18 causes differential movement between the device 50 and clothes 64, giving rise to friction causing the conversion of kinetic energy to electric energy. As the device is moved the resulting positive and negative electric charges are displaced causing the charge to effect water 62 in the immediate vicinity.

This embodiment of this invention is made with surfaces, vanes, or filaments of a material having frictioning properties, and is caused to pass through the water among the clothes in a standard washing machine of the prior art by the flexing action induced by the agitator of that washing machine, thus rubbing against fabric, giving rise to electric charge. Simultaneously those same surfaces, vanes, or filaments distribute that charge in the vicinity of the fabric being cleaned.

Frictional Electric Charge Generation—FIG. 5

FIG. 5 illustrates the mechanism of frictional electric charge generation, distribution, and application means. Differential movement 48 between a fiber of cloth 66 and filament 10 as filament 10 is dragged along by attached end 14 causes rubbing to occur between fiber 66 and filament 10. This washing action rubbing along with the frictional and electrical properties of the material with which filament 10 is made, cause electrons 44 to be rubbed off fiber 66 and stick to filament 10. As filament 10 is dragged along, the distance between the source of electrons 44 and their current location gives rise to a negative static electric charge 44 on the surface of filament 44 and an unbalanced positive electric charge on the fiber. In the presence of a substance having low conductivity, such as water, surface electric charges 44 and 46 do persist, but for only a short time. There is empirical evidence that electric charge also builds up inside the material of which fin 10 is made, and, being much more effectively insulated from the water by the dielectric characteristic of that material remains active, functioning as an electret. The function of electric charge in doing the work of cleaning is adequately described in the section on theoretical basis. Independent of the source of the differential electric charge 44 and 46, be it from friction, a conventional electronic device, piezoelectric properties of materials of construction, or any other source, the mechanism of hydrolization within water 62 remains the same. There are theories that different parts of the mechanism are more dominant dependent on voltage and current, but the results are always changes in the physical properties of water 62 if only momentarily, but long enough to do the work of cleaning.

Preferred Embodiment

FIG. 6 shows a fin, vane, filament, or elastomer 10 of a preferred embodiment having the same function and general appearance as in other embodiments. Each of the plurality of fins 10 of this preferred embodiment are made of or coated with a substance 68 which has detergent acting surface molecules as described elsewhere herein in the section on theoretical basis. An example of such a material is a copolymer with a terminal benzoic acid group. These surface detergent molecules alternately attract and repel, (cling to and release) dirt as the polarity of the electric charge alternates due to the back and forth flexing of fin 10 caused by the agitator or by other means. The net result can be visualized as similar to the result obtained by rubbing something with a wash rag to transfer the dirt to the rag, then rinsing the rag in wash water. However, in this case, the electric energy rather than kinetic energy does the work more efficiently.

Alternate Embodiments

The inventive method of utilizing electric energy to do the work of cleaning by producing a charge, distributing that charge to the location of cleaning, and applying the charge to the water in the immediate vicinity of the work to be done, may be embodied by many various designs.

One design shown in FIG. 7 is a special agitator 70 of a conventional washing machine (not shown) made out of special electric charge producing material. Such special material is at least one of those described elsewhere herein, or an alternate material functioning to produce charge.

Another design shown in FIG. 8 is a piezoelectric agitator 72 in a conventional washing machine (not shown.) Piezoelectric agitator 72 is made out of durable, flexible, piezoelectric polymer or composite such that the edges of agitator 72 flex, providing generation, distribution, application of electric charge in similar fashion as the agitator fin extenders described in embodiment one above.

Another design shown in FIG. 9 is a special capacitative agitator 74 and/or other parts (not shown) of a conventional washing machine (not shown). Agitator 74 is designed as be a one electrode capacitor to be means to distribute and apply the electric charge generated elsewhere. One design for agitator 74 is plastic coated metal 76 (one electrode capacitor with environment as second electrode) then optionally coated with surface detergent 68. The energy of electric charge is supplied by a conventional electric charge generator 80 connected to agitator 74 by electric wiring 82 The charge supply is either constant or alternating.

FIG. 10 shows still another simple, yet practical embodiment. An agitator 18 of an existing conventional washing machine (not shown) is sprayed with the proper composition material in the form of a spray on coating 78.

Each of the alternate embodiments produces the electric charge by some means, distributes the energy of the charge by virtue of being at the right place at the time, and applies that charge by virtue of continuing to produce charge by the input of kinetic or some other form of energy as the distribution takes place.

FIG. 11 shows the hypothetical separation of ions in water due to electric charge, and the resulting concentration of ions having detergency in a highly magnified schematic view. This description of FIG. 11 should be read with the above theoretical basis description of Hypothesis 2 in mind. Hydrogen ions ($H^+$) 86 and Hydronium ions ($H_3O^+$) 88 being positively charged are attracted to the negative charge 44 which is a build up of electron concentration 44 in the vicinity of fin 10, where Hydrogen ions ($H^+$) 86 and Hydronium ions ($H_3O^+$) 88 are concentrated due to attraction of opposite charges. Hydroxide ions ($OH^-$) 92 and Hydroxyl ions ($H_3O_2^-$) 94 being negatively charged are repelled from the negative charge 44, away from fin 10, to the vicinity of a fiber of cloth 66 with particles of soil, oil, dirt, micro organism, or foreign matter 84 being held to fiber of cloth 66 by forces of soil adhesion which must be overcome in the cleaning process, where Hydroxide ions ($OH^-$) 92 and Hydroxyl ions ($H_3O_2^-$) 94 are concentrated due to repulsion of like charges. Having detergency characteristics, Hydroxyl ions ($H_3O_2^-$) 94 are attracted to soil particle 84 by detergive attraction 96 where Hydroxyl ions ($H_3O_2^-$) 94 surround soil particle 84 and separate soil particle 84 from fiber of cloth 66, thus cleaning fiber of cloth 66. Water molecules ($H_2O$) 90, being neutral in charge, are more concentrated in the area between the concentrations of charged ions where the charged ions are separated from water molecules ($H_2O$). Being separated from the charged ions, the natural disassociation of water into ions results in more charged ions, which are further separated from each other, thus driving even greater concentration of detergive ions into the area immediate to the fiber of cloth where cleaning takes place.

Operation of Invention

How the Invention Works

An object of this invention is to exploit another form of energy, the energy of electric charge, in an application which fills those long recognized and unfilled needs for increased effectiveness of cleaning, and reduction of pollution produced by household laundry operations.

The general embodiment of this invention is made with surfaces, vanes, or filaments of a material having frictioning properties, and sufficient surface area, and is caused to pass through the water among the clothes in a standard washing machine of the prior art by the flexing action induced by the agitator of that washing machine, thus rubbing against fabric, giving rise to electric charge. Simultaneously those same surfaces, vanes, or filaments distribute and apply that charge in the vicinity of the fabric being cleaned.

As an embodiment 50 (FIG. 4D) according to the invention passes through the water 62 among the clothes 64 it drags electrons 44 (FIG. 5) along by friction with the fiber 66 of clothes or by flexing of vanes or filaments 10 (FIG. 3F) causing the rise of electric charge 44. The electric charge 44 causes several immediate effects in the water. As the electric charge immediately drains off, (described in section on theoretical basis) the electric charge causes micro turbulence and hydrolyzes the water in the immediate vicinity of the micro turbulence. This hydrolization of the water reduces the surface tension momentarily in the vicinity of the micro turbulence. This sets up the conditions which causes removal of soil particles from the interstices of the cloth. These conditions include turbulence, reduced surface tension, and the physical property of detergency. No lasting effect is caused in the properties of the water. The only lasting effect is the soil particles have been removed from the clothes and are held in suspension in the water until the water is removed from the clothes by draining away. That lasting effect too, is short lived. After a few minutes the residual detergive qualities of the discarded waste water which hold the soil in suspension fade away, and the water naturally separates itself from the soil particles held in suspension.

Of the four forms of energy added to water to effect the work of cleaning, the electrostatic energy is the safest. Hot water can scald your hand. Hot water sets stains. An agitator used to induce turbulence can injure your hand. Turbulence wears out fabric. Chemical detergents can irritate your skin. Chemical detergents pollute the environment. Electrostatic energy does not set stains, does not wear and tear the fabric and does not pollute the environment. Electrostatic energy simply overcomes the forces holding the soil to the fabric thus separating the soil from the fabric. Electrostatic energy simply promotes temporary physical property changes in the water which work to separate the soil and hold it separate in the water until the water is separated from the laundry. The electrostatic energy is the same as is built up on the comb when combing your hair when it is very dry. When combing your hair, long before you can experience a slight shock, electrostatic energy can be detected by picking up bits of paper with an electrified comb. Electrostatic build-up only occurs in air when the air is very dry. In wet laundry there is no dangerous static build-up, the conditions are very wet and the electrostatic energy is quickly dissipated into the water as it does it's work of cleaning.

Surface Detergent Modulated by Electric Charge

Another object of this invention is to exploit surface chemistry properties of detergency, and using the energy of electric charge to modulate these properties in an application which fills that long recognized and unfilled need for reducing laundry chemical waste which is polluting the environment.

Surface chemistry refers to chemical reactions that occur on the surface of a solid reacting in and with a fluid rather than reactions between and among chemicals dissolved in a fluid. In the past, detergents were chemicals in solution rather than on and part of a surface. Being in solution, the chemical detergent was discarded with the wash water.

This new inventive method uses a chemical detergent which is detergent attached to the surface of a solid substance rather than dispersed throughout the wash water. The chemical detergent is therefore completely recycled and never thrown away with the wash water. The function of a surface detergent is to separate the soil from the laundry. In conjunction, the function of alternating electric charge is to modulate the function of the surface detergent to periodically cause the surface detergent molecules to separate themselves from the soil and to stimulate temporary detergency properties of plain water. Only the removed waste soil is left in the water. Since most of the soil in laundry is from the environment, returning the soil to the environment is non-polluting. In addition, since there is no chemical detergent in the waste water to hold the soil in suspension, the soil rapidly settles out after being discarded, leaving a much cleaner water to be recycled to the environment.

A material having piezoelectric properties will produce an electric charge when flexed, then produce an electric charge of the opposite polarity when flexed the opposite direction. Piezoelectric polyvinylidene fluoride (PVDF) is an example of a plastic substance having piezoelectric properties. Other examples are composite materials too numerous to list. An embodiment of this invention made with vanes or filaments of a flexible material having piezoelectric properties, and having a surface chemistry physical property of detergency is modulated as described above by the flexing action induced by the agitator of a washing machine.

Conclusions, Ramifications, and Scope

Accordingly the reader will see that according to the invention, electric energy is added to the traditional three forms of energy to do the work of cleaning. Providing any means to supply electric energy, any means to distribute electric energy, and any means to apply electric energy, according to this invention, reduces or eliminates the need for chemical detergent pollution from home laundry operation to a greater extent than possible with heretofore available technology.

While the above description contains many specificities, these should not be construed as limitations on the scope of the invention, but as exemplifications of the presently preferred embodiments thereof. Many other ramifications and variations are possible within the teachings of the invention. No particular apparatus description is to limit the scope of the means to provide electric energy. No particular apparatus description is to limit the scope of the means to provide distribution and application of that energy.

For example, a piezoelectric, or frictional electric device, when flexed or rubbed under water induces electric charge into the water, distributing that energy in the water and applying that energy at the site of the work of cleaning. The device is flexed back and forth by the action of agitation. The device can be attached to the agitator in the washing machine as an add on device, it can be integrated into the agitator itself, it could be a spray on substance having particular frictional electric properties, or it could be a device not connected to anything, yet receive kinetic energy through the agitation action of the water itself. It could be positioned away from the agitator and receive kinetic energy to do the flexing from some other source. It could be assisted by or wholly dependent upon electric charge from a charge producing electronic device wired to distribute the electric energy to the vicinity of the cleaning work being done. Very simply implemented, the electric energy could be generated at the same point in space and time that the turbulence is working, thus the means for distributing and application are incorporated in the generation means.

A further example is a laundry cleaning ball shaped device coated with a polymer having surface detergent properties and having these properties modulated by an electric charge from energy transmitted to the ball from a conventional transmitter via ultra sonic or microwave energy. Such a ball could be a passive energy receiver having conventional electronic receiving circuitry and conventional electronic power conversion circuitry to convert received energy into an electric charge which changes with time or with a change in characteristics of signal transmitted to such a ball. Such a ball could have segments of it's surface of opposite polarity by use of metal segments underlying the surface detergent polymer coating. Such a ball could be of any size from micro circuit to a large proportion of a washing machine such balls could be used in multiple quantities and automatically separated from the items being washed after washing by another property of the ball such as magnetism. The balls could even be automatically removed from items of laundry after being put inside a dryer by such a mechanism as a special trap to capture and hold the balls. Such a device need not be round in the shape of a ball. Almost any shape could be used as long as it did not interfere with the circulation of the object within a cleaning container.

Surface detergent of this invention could be used without electrical modulation during the laundry process. It could be made into tiny laundry granules just large enough to be caught and trapped by a screen such as a lint screen. These granules could be added to the laundry just as conventional detergent powder, then toward the end of the washing cycles the water could be circulated through such a trap where the granules could be caught to be externally renewed and recycled.

The invention has uses beyond normal home laundry. Dry cleaning, car parts washing, farm produce washing, separation of clay from gold in a mining operation are but a few of the obvious uses.

Many obvious modifications come to mind that have not been included above. Examples of such things that anyone versed in the art would assume to be obvious are:

The size is not limited to that of the standard household washing machine. A much larger or smaller version is obviously within the scope of the invention.

Substitution of various assemblies for individual components, or the addition or deletion of various assemblies in place of individual components are but a few among many of the various options.

Where various mechanisms of charge generation have been described others such as direct thermal energy conversion could be substituted.

Cleaning fluid or other washing solution could be used instead of water.

Other water treatment device or devices may be used in conjunction with the invention. Water treatment device may be an option depending on water condition in users area.

The washing container does not have to be a conventional laundry washing machine. It may be oval or some other shape. It may be a dish washing machine with electric charge distribution among the dishes and electric charge from a conventional electronic high voltage circuit. It may even be a scrub board and bucket of water.

The shape does not have to be round. It could be curved. It could be in the shape of a conveyor belt. Many parts that have been shown one shape could be another.

The invention may be implemented as a single-unit or as multiple units.

The invention may be free to move randomly or it may be anchored.

Some embodiments could even be operated in case of a lack of power. The embodiment could be used to massage the item of clothing in the presence of water, by hand or by foot, then the clothing removed and hand wrung.

In an alternate design for an anchored embodiment, the items to be cleaned could be moved rather than the device itself.

Alternate uses could by made such as washing one's hair with the inventive device rather than with or in addition to using shampoo.

While plastic or rubber has been described, a more rugged embodiment could have many parts made of metal.

Many items detailed above are optional, and can be omitted. Many can be changed in size, made of different material, made of a different shape, connected or associated in a different manner, made integrally or in sections, or varied in other ways without departing from the invention in its broader aspects. These items are offered by way of illustration only and not as a limitation.

Several alternate scrubbing actions and means of generating those actions have been described. Others too numerous to include are obvious to one versed in the art. A set of multiple agitating methods could be used simultaneously, or alternatingly.

While specific theory and hypothesis have been described, actual detail may vary. For example it is not clear whether electron build up in under water charge is exterior to surface or interior to surface of diaelectric material. We do not wish to be limited thereto as the validity of the invention has been empirically established.

While particular embodiments of the present invention have been shown and described, it will be obvious to those skilled in the art that changes and modifications may be made without departing from the invention in its broader aspects. For example, where water is mentioned throughout the descriptions, it is obvious that other cleaning solution may be substituted. (Other fluids, for example, petroleum based fluids, have demonstrated a similar physical properties change when under the influence of an electric charge.) Where plastic or rubber are mentioned throughout the descriptions, it is obvious that other non conductive or piezoelectric materials may be substituted, where piezoelectric electric charge is mentioned in the descriptions, it is obvious that electric charge from another source may be substituted, where textiles or clothes are mentioned throughout the descriptions, other objects could be washed including such diverse items as farm produce or the removal of clay from placer gold. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A method for employing electric energy to do cleaning, said method comprising:

(a) providing an electric charge generating means for rapidly generating said electric charge;

(b) providing a distributing means for distributing said electric charge and for separating opposite polarities of said electric charge;

(c) providing an applying means for directly applying said electric charge in the immediate proximity of said cleaning and at the immediate time of occurrence of said cleaning;

(d) providing a washing fluid;

(e) providing at least one item to be cleaned; and (f) imparting a washing action to said item to be washed and to said applying means in the presence of said washing fluid, and wherein said washing fluid, said item to be cleaned, and said applying means all interact in said washing action, resulting in said electric charge, modifying at least one physical property of said washing fluid in the immediate proximity of said item to be cleaned at the immediate time of occurrence of said proximity, and whereby said modified physical property of said washing fluid results in improved cleaning of said item to be cleaned and after said immediate time of occurrence, said electric charge locally diminishes, and said modification of said physical property of said washing fluid rapidly locally diminishes.

2. The method of claim 1 wherein said electric charge generating means, said electric charge distributing means, and said electric charge applying means are all integrated into one means.

3. The method of claim 1 wherein said washing fluid is a fluid selected from the group consisting of, (a) water, (b) water and a detergent mixture, (c) chemical solvent based cleaning fluid, (d) water and air mixture, (e) a combination of fluids.

4. The method of claim 1 wherein said physical property of said washing fluid is at least one selected from the group consisting of, (a) surface tension, (b) permeability, (c) micro-turbulence, (d) ionic concentration, (e) ionic dissociation, (f) ionic distribution, (g) detergency, (h) hydrolization, (i) direct electrostatic, (j) molecular attraction, (k) hydrophobic attraction, (l) attraction, and (m) repulsion.

5. The method of claim 1 further including:

(a) providing a surface detergent on at least one surface of said applying means; and (b) providing an electric charge modulating means;

wherein said surface detergent, said washing fluid, said item to be cleaned, and said applying means all interact in said washing action, resulting in said electric charge modifying at least one physical property of said surface detergent, and whereby said modified physical property of said surface detergent results in improved cleaning of said item to be cleaned.

6. The method of claim 5 wherein said physical property of said surface detergent is at least one selected from the group consisting of, (a) adhesion, (b) attraction, and (c) repulsion.

* * * * *